United States Patent [19]

Tolliver et al.

[11] 3,939,879

[45] Feb. 24, 1976

[54] METHOD AND APPARATUS FOR FORMING PIPE REINFORCING CAGES AND LIKE CLOSED LOOP OBJECTS

[75] Inventors: Wilbur E. Tolliver, Holland; Daniel J. Borodin, Detroit, both of Mich.

[73] Assignee: New York Wire Mills Corporation, Tonawanda, N.Y.

[22] Filed: Jan. 20, 1975

[21] Appl. No.: 542,343

[52] U.S. Cl. ..... 140/107; 140/112; 214/1.7; 219/56

[51] Int. Cl.[2] ..... B21F 33/00

[58] Field of Search ..... 140/102, 107, 112; 219/56, 219/57, 58; 226/92; 214/1.7; 228/17.5, 144, 149, 150, 151

[56] References Cited

UNITED STATES PATENTS

| | | | |
|---|---|---|---|
| 2,041,235 | 5/1936 | Darbaker | 214/1.7 |
| 3,370,150 | 2/1968 | Nordgren | 219/56 |
| 3,561,501 | 2/1971 | Fauteux | 140/107 |

*Primary Examiner*—Lowell A. Larson
*Attorney, Agent, or Firm*—Price, Heneveld, Huizenga & Cooper

[57] ABSTRACT

Apparatus for forming a closed loop object such as a pipe reinforcing cage from wire fabric includes an infeed carriage assembly receiving sections of wire fabric and transporting the fabric to a pair of gripping assemblies. Each gripping assembly includes rotatable gripping jaws mounted on a slide in turn positioned on a carriage for motion toward and away from each other such that opposite ends of the fabric can be brought together while rotating the gripping jaws to form a cylindrical cage. Speed control means are provided for assuring the gripping jaws advance toward each other in synchronism with the rotation of the jaws thereby forming a perfect cylindrical cage. Welding means are provided for welding the ends of the cage so formed while held in position by the gripping jaws.

50 Claims, 29 Drawing Figures

METHOD AND APPARATUS FOR FORMING PIPE REINFORCING CAGES AND LIKE CLOSED LOOP OBJECTS

BACKGROUND OF THE INVENTION

The present invention relates to apparatus for forming wire fabric cages used in reinforcing concrete pipe. In the manufacture of pipe reinforcing cages, wire fabric is typically passed through a set of forming rollers which bend it into a cylinder. Its ends are then welded together. Such a system is represented by U.S. Pat. No. 3,678,971 issued July 25, 1972 to Alfred A. Nordgren. Also, cages have been manufactured by laying out the longitudinal wires for the pipe cage and holding them in position while circumscribing them with a spiral wrap wire, welding the junctions to complete the cage. Such a system is disclosed in U.S. Pat. No. 3,437,114 issued Apr. 8, 1969 to D. P. Whitacre et al.

Both of the above methods are time-consuming. After cages are formed by bending them through forming rollers, the ends of the fabric must be welded. Such welding is typically done manually and automatic welders for such cages have not been particularly commercially successful.

Both the Nordgren and Whitacre machines require readjustment every time one wants to manufacture different sized cages. Thus, the machine must first be set up for a run of a large number of cages. To then do cages of a different size, the machine has to be reset up for the new sized cages.

This is inconvenient since cage assemblies are frequently used in which a smaller diameter cage is positioned inside a larger diameter cage for subsequent molding into a concrete pipe. The necessity of doing large runs requires that a number of cages of the same size be stored at some point on the manufacturing floor for later assembly with different sized cages of a subsequent run.

SUMMARY OF THE INVENTION

The method and apparatus of the present invention facilitates the fully automated production of pipe reinforcing cages or of any like cylindrical or closed loop object, and even facilitates sequentially manufacturing cages of different sizes by simply feeding into the system wire fabric sections, or work pieces, of differing lengths.

In the present invention, the ends of the work piece are gripped by gripping means which are simultaneously rotated towards one another and advanced towards one another whereby the free ends of the work piece are rolled over inwardly towards one another and advanced towards one another to create a closed loop. In a preferred aspect of the invention, synchronism means are provided for synchronizing the rate of rotation of the gripping means with the rate of advancement of the gripping means towards one another.

Other preferred aspects include the provision of a welding means located approximately at the point where the two gripping means bring the ends of the work piece together. A unique line upset welding method is employed in accordance with the present invention to facilitate a sound weld and indeed, 100% line upset welding is facilitated whereby the ends of the pipe reinforcing cage or the like are squared rather than skewed. To feed different sized work pieces into the apparatus, a unique infeed carriage assembly is employed.

These and other advantages, features and objects of the present invention will be more fully understood and appreciated by reference to the written specification and appended drawings.

DETAILED DESCRIPTION OF THE PREFERRED EMBODIMENT

Figure 1A:
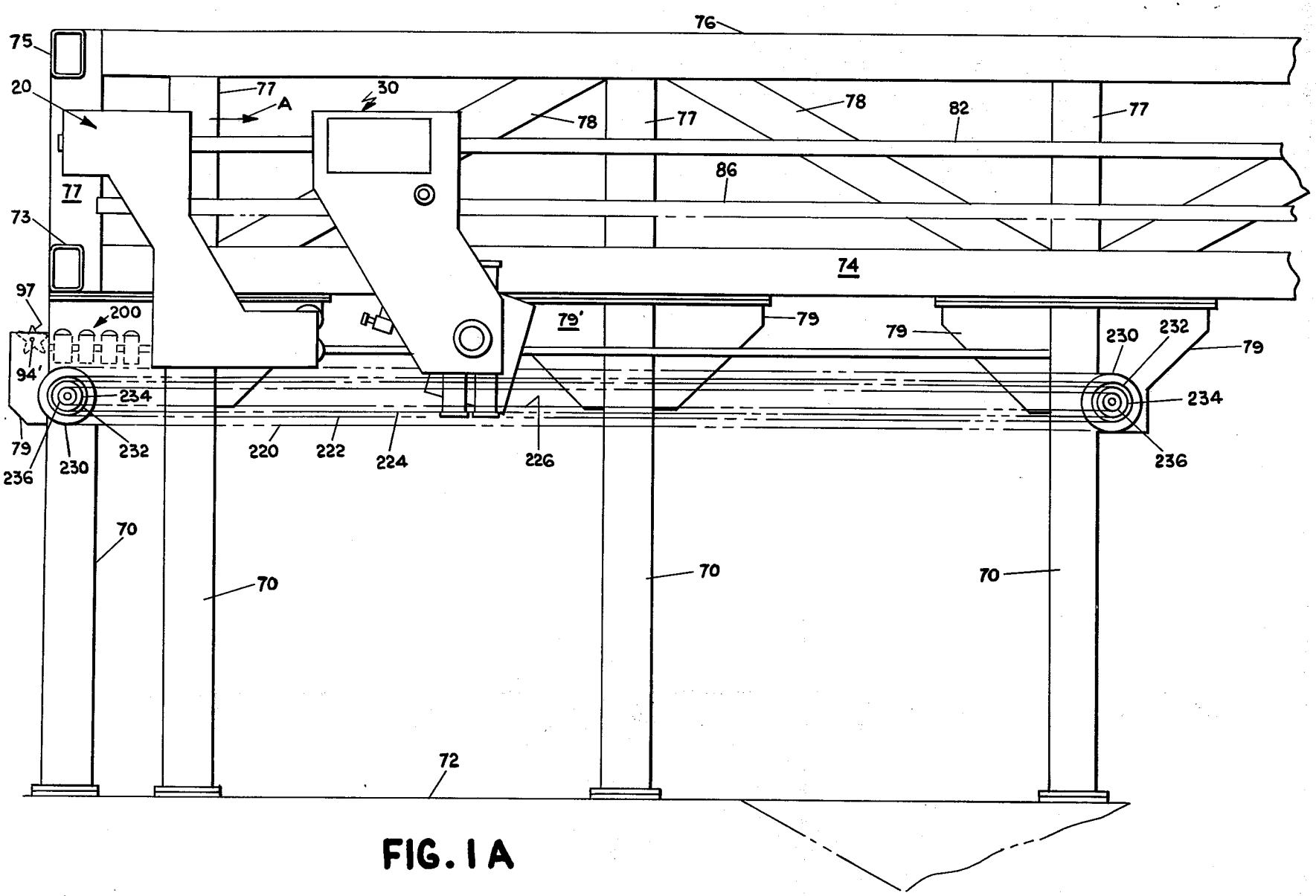
FIG. 1A is a front elevational view of the left end of apparatus embodying the present invention.

Before discussing the structural details of the apparatus embodying the present invention, a brief description of the principal elements of the machine together with their function is presented here. The machine receives a precut section of wire fabric 10 at the left end as seen in FIGS. 1 and 2. Fabric 10 includes longitudinally extending parallel wires 12 which when the cage is formed, define the circumferential wires of the reinforcing cage. Extending transversely to the circumferential wires 12 are transverse wires 14 which become the longitudinally extending wires of the formed cylindrical cage. The precut section 10 of wire fabric is received from a shear machine (not shown) which draws fabric from a roll supply of such fabric, cuts the fabric to a desired length which corresponds to the circumference of a cage to be formed, slightly bends the free ends of the circumferential wires 12 extending from the adjacent transverse wire and introduces the precut section 10 into the cage forming machine infeed means 20 shown at the left end of FIGS. 1 and 2.

Figure 13:
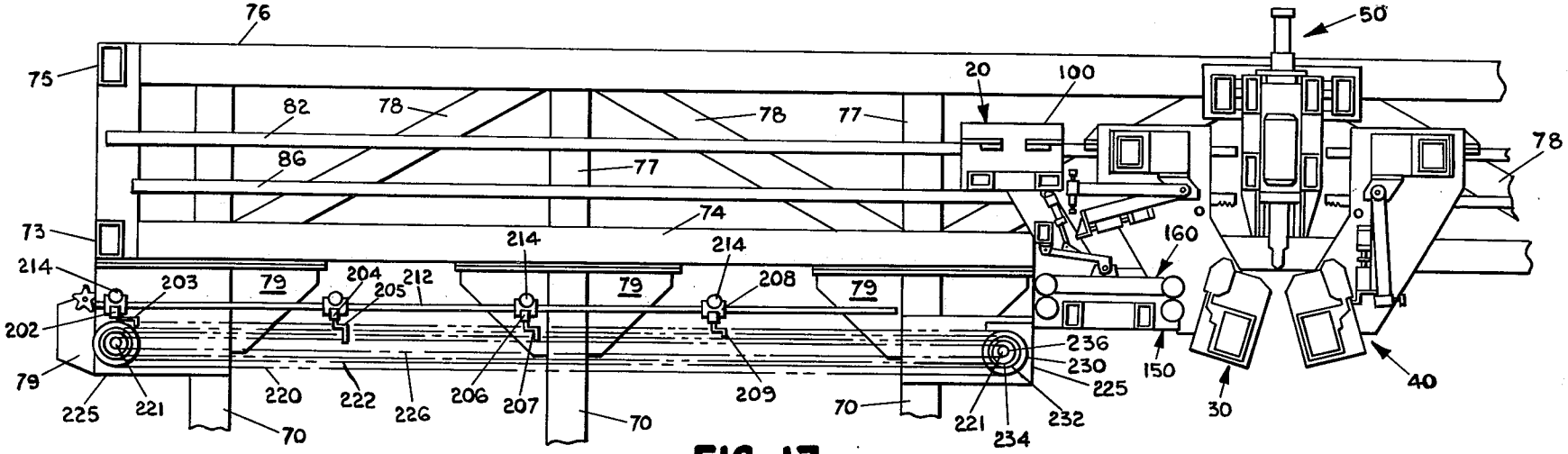
FIG. 13 is a fragmentary front elevational view of the apparatus of the present invention shown during a successive portion of a cycle of operation.

Means 20 includes a movable carriage 100 (FIG. 4) and clamping means 140 which are in an open position to receive the wire section and which can be closed to clamp the wire section therebetween for transporting the fabric section to the right in the direction indicated by arrow A in FIGS. 1 and 2 for introducing the fabric section to awaiting gripping members (FIG. 13). The clamping means of the carriage include movable belts which can be intermittently driven for forcing the fabric section from the carriage means and into the awaiting gripping members. Once this is accomplished, the clamping means open and the carriage returns to its leftmost position shown in FIGS. 1 and 2.

The gripping means comprises a left gripping assembly 30 and a right gripping assembly 40 movable toward the middle of the machine when forming a wire cage (FIG. 15) and receiving a new section of wire and to an outermost position, best seen in FIGS. 1 and 2, where they grip the fabric section near the ends and are in preparation of advancing toward one another. Each of the gripping assemblies includes a pair of gripping jaws 240 and 250 (FIG. 11) for holding the fabric. The gripping jaws are mounted between rotatable mounting plates 244 and 276 such that as the gripping members are advanced toward the center of the machine to bring the free ends of the fabric section together, the fabric ends are rotated in synchronism to form the circular cross section cage. The gripping jaw plates are coupled to slides 280 which are coupled in turn to carriages 280' for advancing the gripping jaws toward and away from each other. The slides are coupled to the carriages by biasing means and include inertial detection means for controlling the speed of advancement of the carriages to be in synchronism with the jaw rotation for assuring that a perfect cylindrical cage is formed.

As seen in FIGS. 1 and particularly 1B, a plurality of different sized pipe reinforcing cages **12*a*–12*e* can be manufactured with the largest diameter being shown in FIGS. 1 and 2** corresponding in circumference to the distance between the outermost position of the gripping assemblies. It is to be understood that any diameter cage, intermediate to those shown, can be manufactured equally as well.

A welding assembly 50 is supported above the machine and movable transversely across the formed fabric cage in a direction indicated by arrow C in FIG. 2 and includes a plurality of welding heads which clamp the mating ends of the fabric section held in place by the gripping members for providing a 100% upset weld to each of the circumferential wires forming the cage. Once the welding operation is completed, the gripping jaws are opened permitting the formed fabric cage to be dispatched from the machine by means of a take-away conveyor 60 (FIG. 20) which is mounted on a vertical adjustment means for accommodating different diameter cages.

Having very briefly described the principal elements of the present invention, a detailed description of each of the elements will be presented herein followed by a description of a cycle of operation.

MACHINE FRAME

Figure 1B:
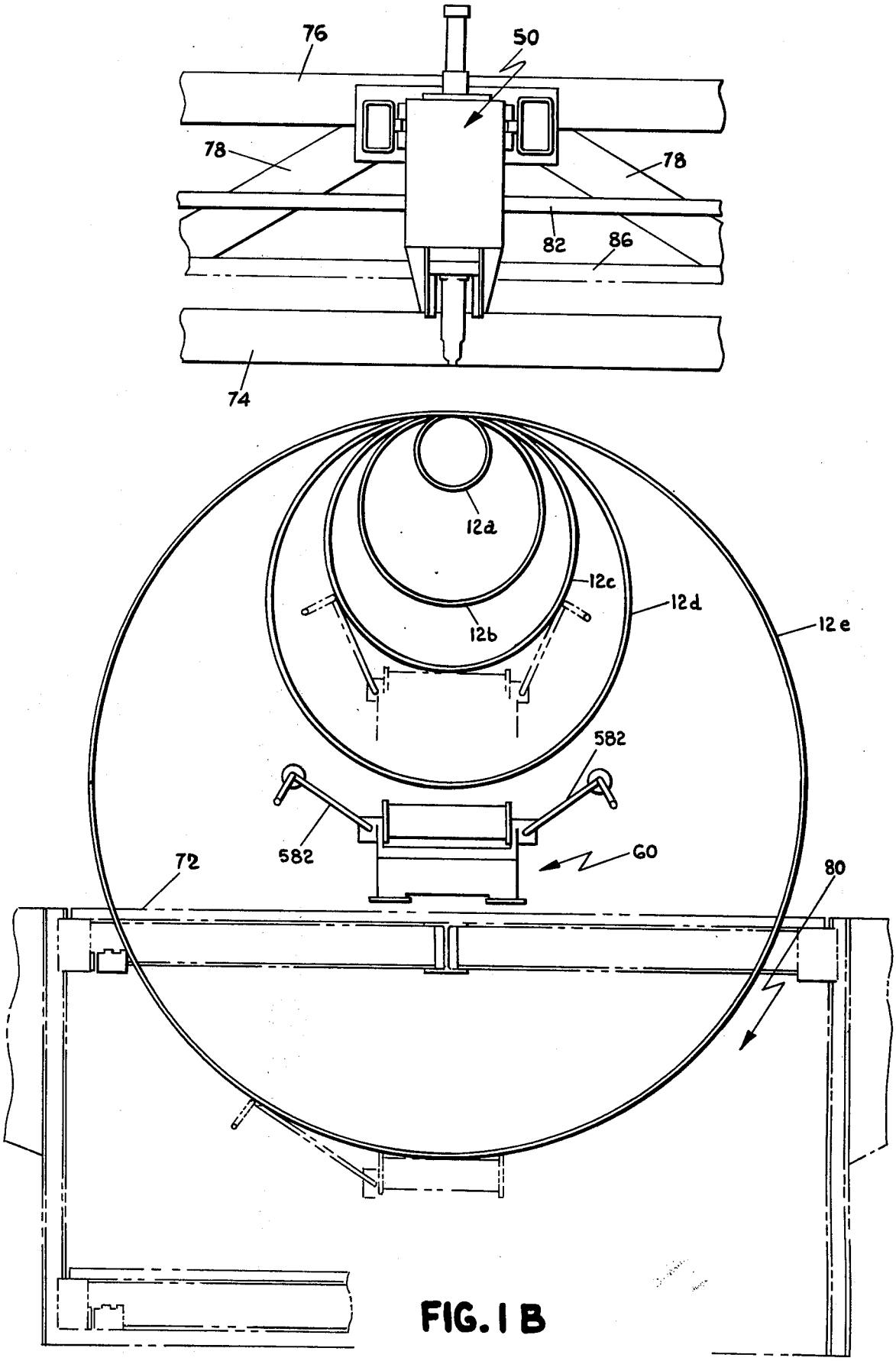
FIG. 1B is a front elevational view of the middle section of apparatus embodying the present invention and is contiguous with FIGS. 1A and 1C.
Figure 1C:
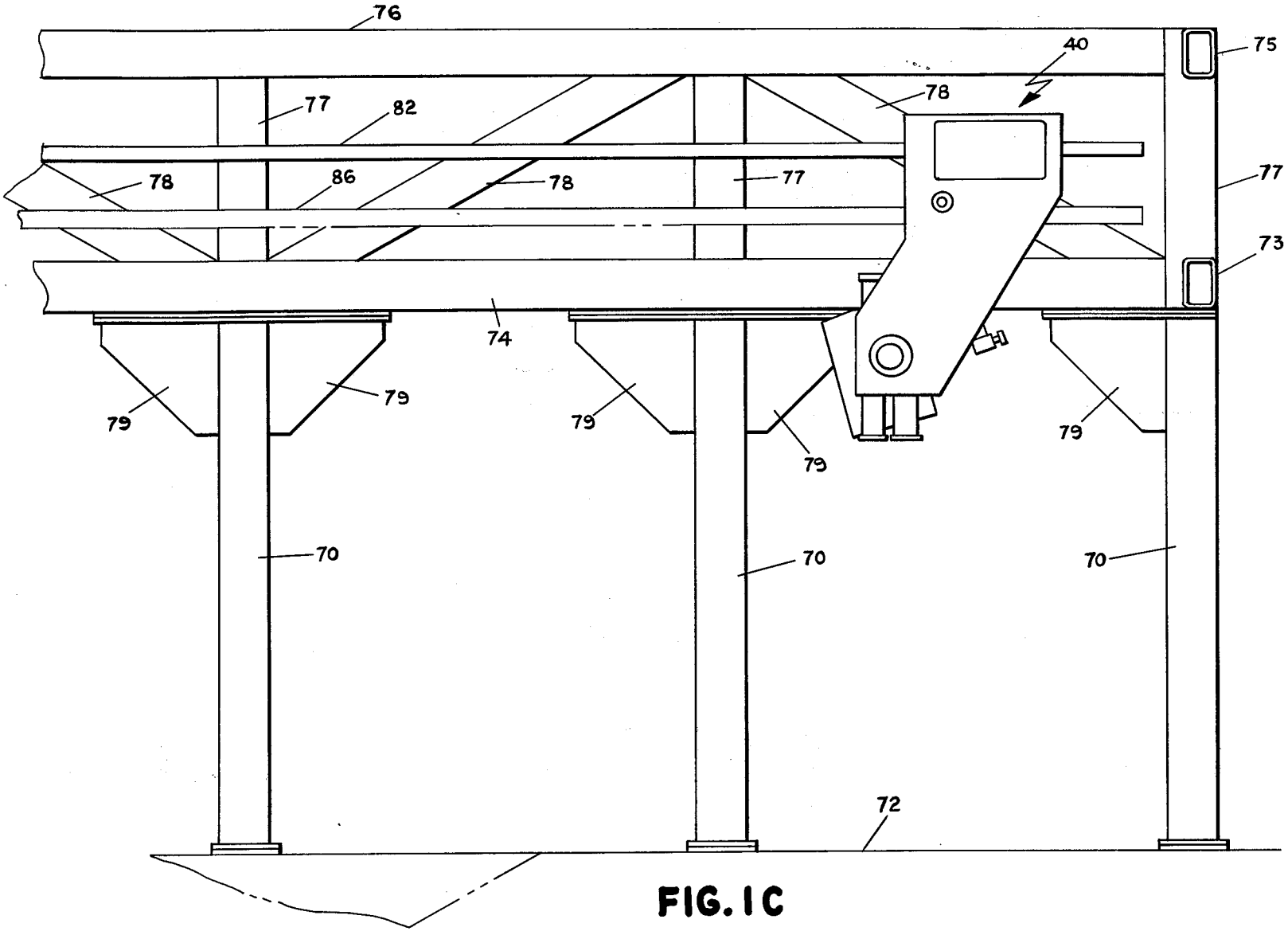
FIG. 1C is a front elevational view of the right end of apparatus embodying the present invention.
Figure 2A:
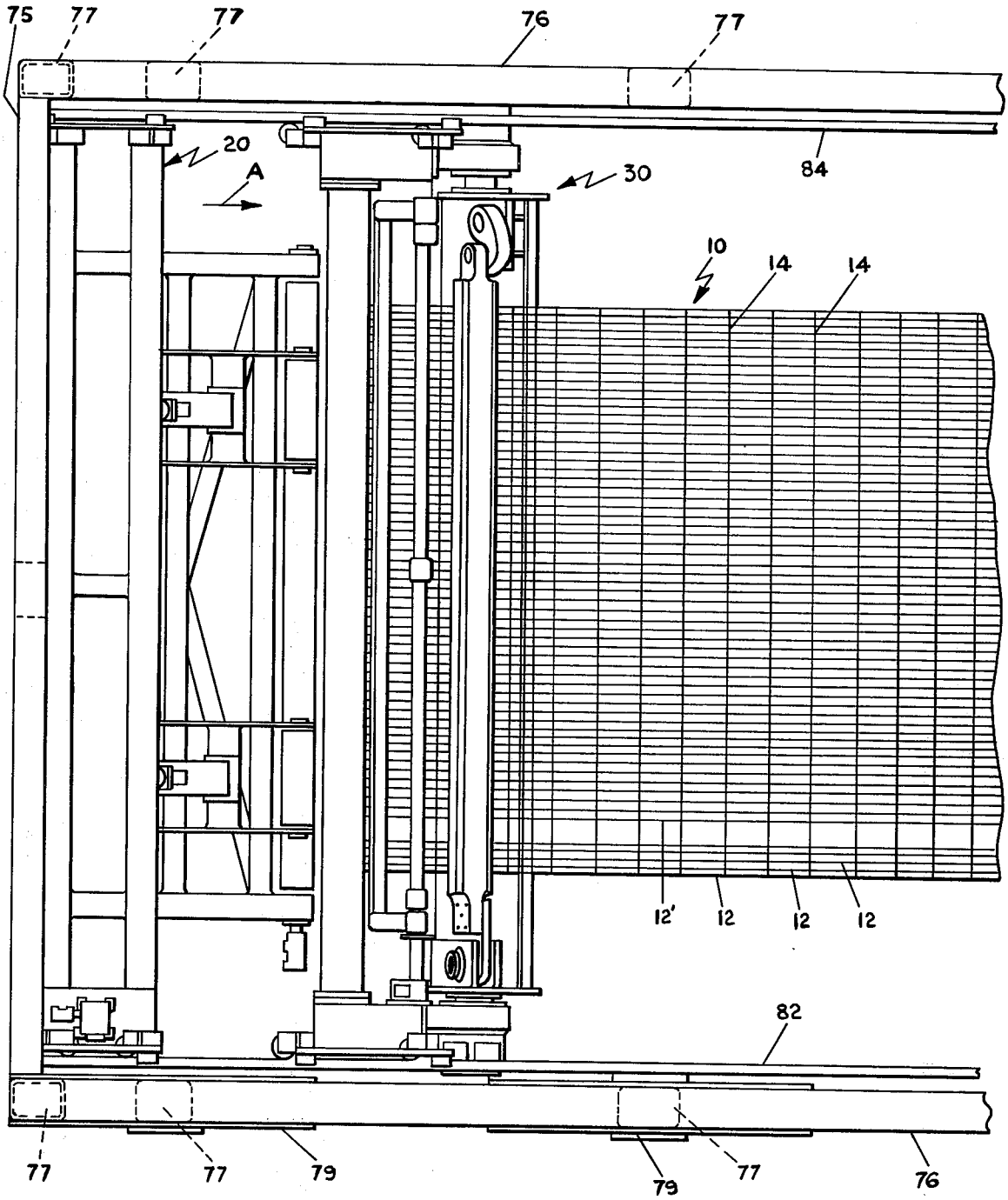
FIG. 2A is a top plan view of the left end of apparatus embodying the present invention.
Figure 2B:
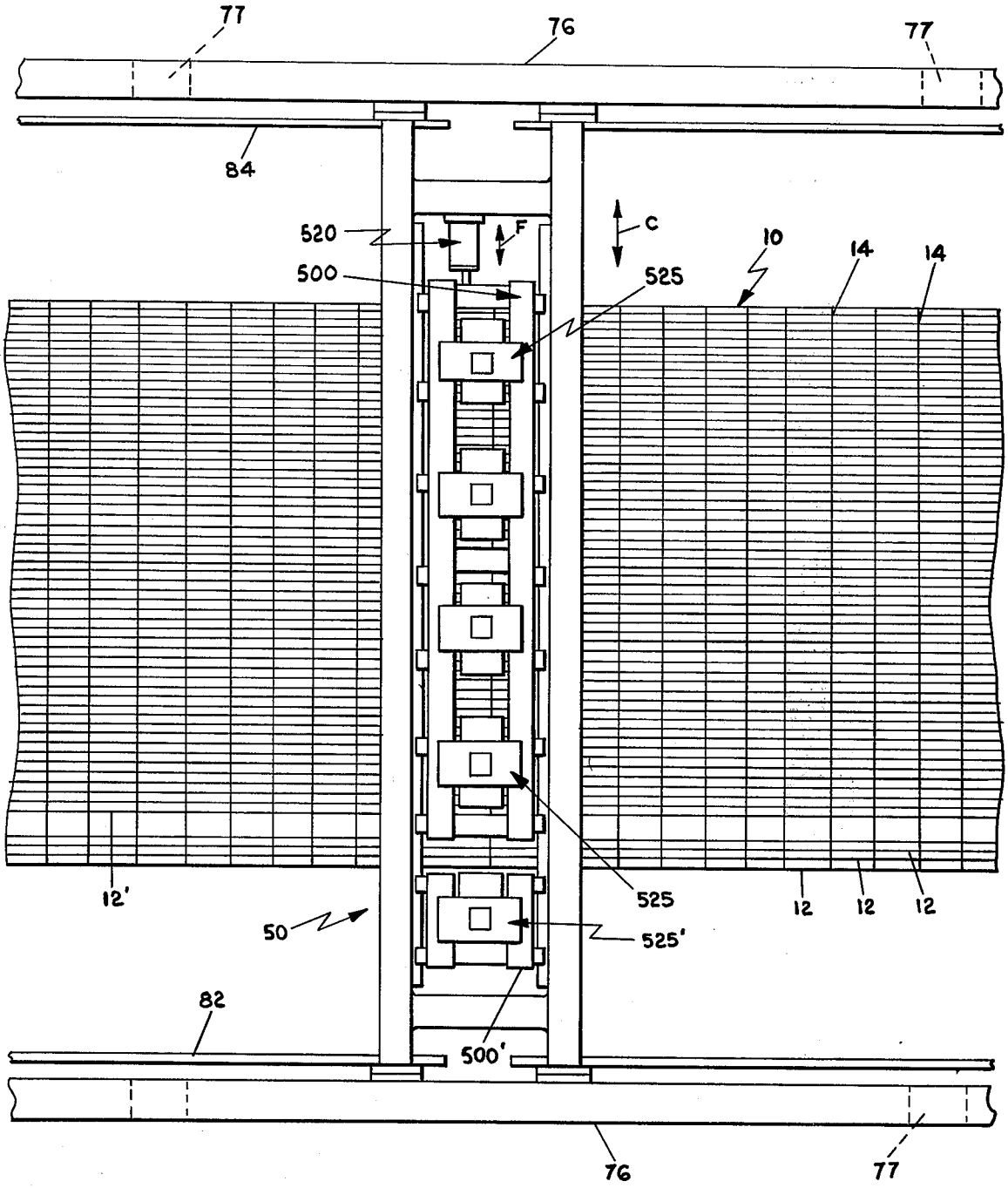
FIG. 2B is a top plan view of the middle section of apparatus embodying the present invention and is contiguous with FIGS. 2A and 2C.
Figure 2C:
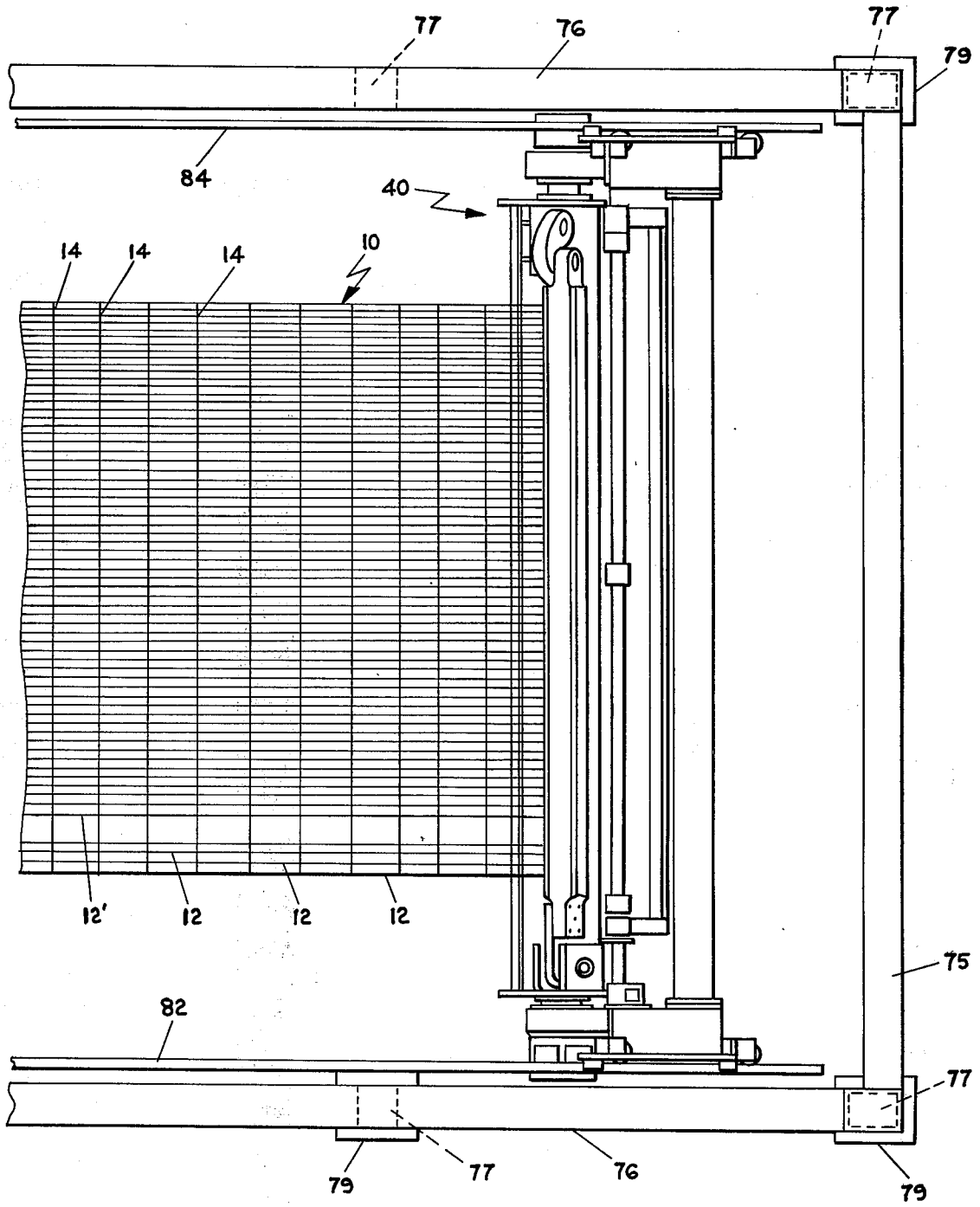
FIG. 2C is a top plan view of the right end of apparatus embodying the present invention.
Figure 3:
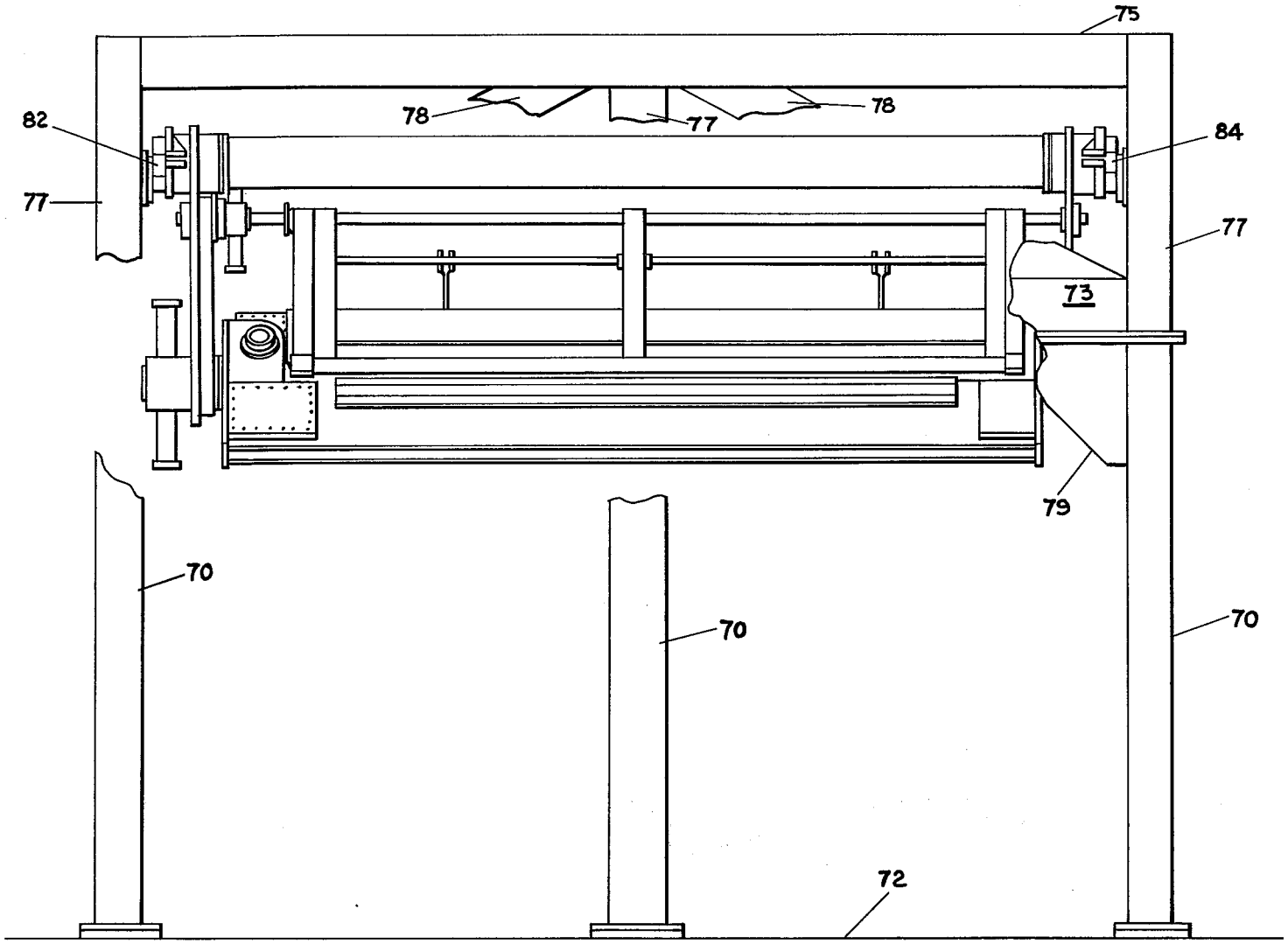
FIG. 3 is a right end elevational view partly broken away of the apparatus embodying the present invention.

As best seen in FIGS. 1A–1C and 2A–2C, the infeed means, the gripper assemblies, and the welding assembly are each movably mounted on guide rails of a stationary framework of the machine. The framework comprises a plurality of vertical stanchions 70 extending between the floor 72 of an installation and the bed of a rectangular framework comprising lower longitudinal support members 74, upper longitudinal support members 76, lower cross supports 73 at opposite ends of the machine, and upper cross supports 75. The lower rectangular frame is coupled to the upper rectangular frame by means of vertical posts 77 and cross braces 78. Posts 77 are preferably located in line with stanchions 70. Reinforcing braces 79 are positioned to support the junctions betweenn the vertical stanchions and the frame members. In the preferred embodiment as seen in FIG. 1B, the take-away conveyor 60 can be mounted in a pit 80 in the floor of the installation such that the machinery height is not excessive for handling the largest diameter pipe cage.

Figure 4:
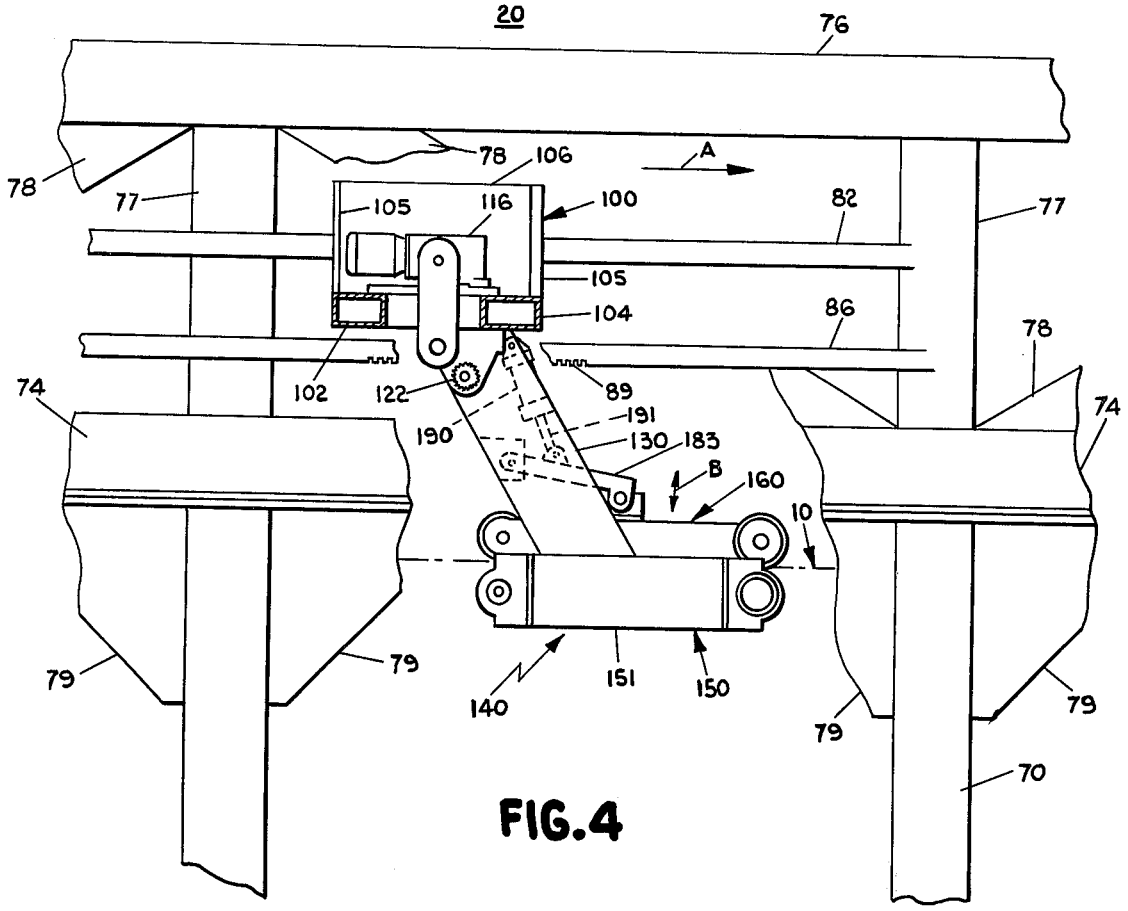
FIG. 4 is an enlarged detailed front elevational view partly broken away and partly in cross section of the infeed means shown in FIGS. 1A and 2A.

Extending significantly the entire length of the framework on opposite sides thereof is a pair of guide rails 82 and 84 which support both the gripping assemblies 30 and 40 for motion therealong as well as the infeed means 20. Positioned below guide rails 82 and 84 is a second pair of rails 86 and 88 (FIGS. 1A–1C and 4 and 5) which, as best seen in FIG. 4, comprises a gear rack having a plurality of teeth 89 formed in the lower surfaces thereof. Racks 86 and 88 serve to provide intercoupling of the drive means for the infeed carriage and gripping assemblies as described in detail below.

INFEED MEANS

Figure 6:
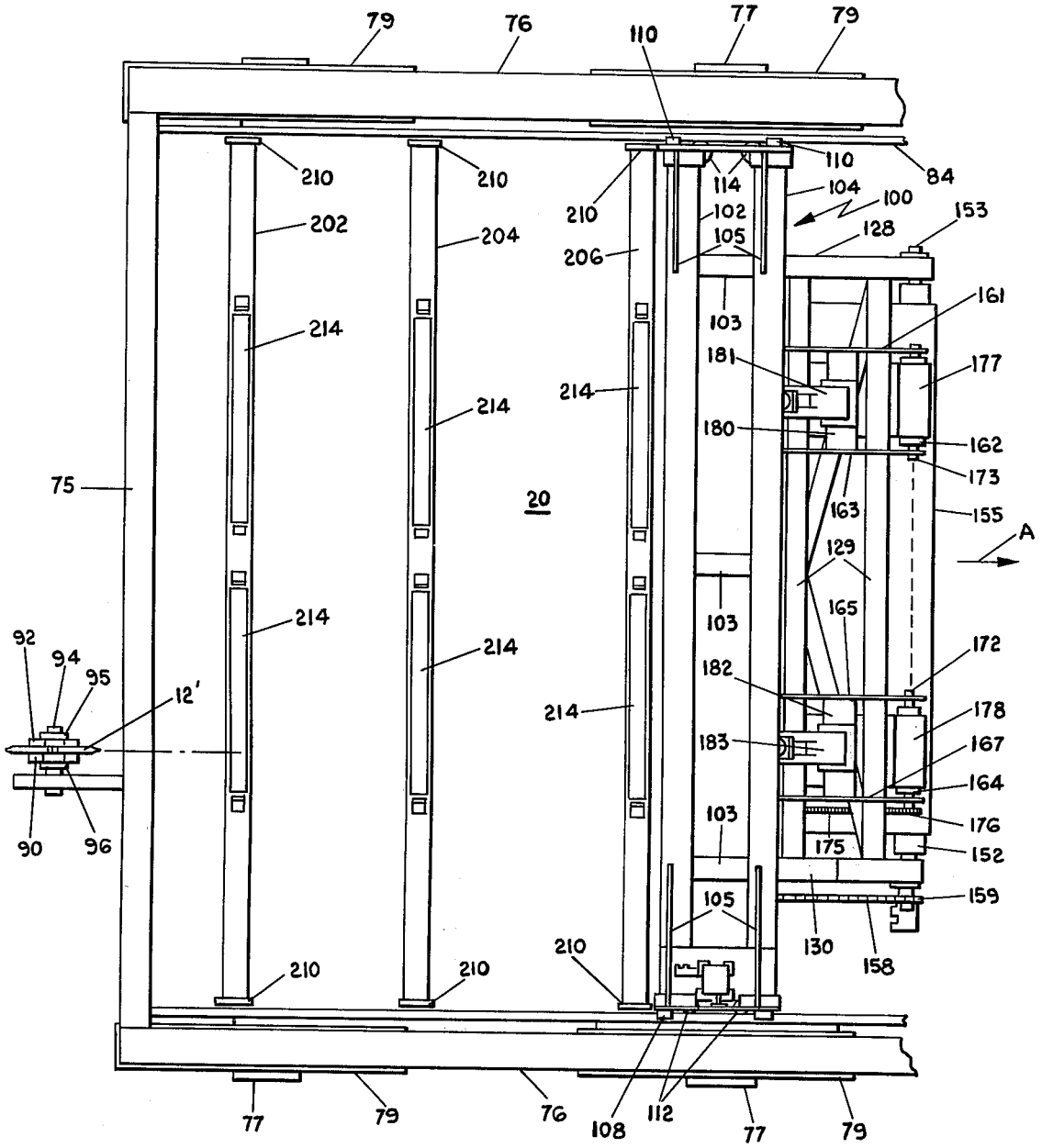
FIG. 6 is a top plan view of the infeed means shown in FIG. 4 and further showing the movable support bed associated therewith.

It is noted here that one of the circumferential wires 12 is utilized as a tracking wire identified in FIG. 2 as wire 12'. As the incoming section of wire fabric enters the forming machine, the tracking wire 12′ is spanned by a pair of star wheels 90 and 92 rotatably mounted to axle 94 by means of bearings 95 and 96, which axle in turn is mounted to bracket 79 as best seen in FIGS. 1A and 6. The star wheels include a plurality of rounded, star-like projecting teeth 97 which define notches therebetween which engage the transverse wires 14 as the wire section is advanced to the input end of the forming machine. Thus, the star wheels, which are vertically positioned to lie in the plane of travel of the wire fabric, assure the longitudinal alignment of the fabric as it enters the forming machine by spanning the tracking wire 12′ and prevent skewing of the fabric.

It is noted here that in the drawings, arrow A indicates motion from left to right in the machine as shown in FIGS. 1 and 2 and is seen in the end view either as an encircled dot indicating the arrow is coming out of the plane of the drawing or a circle with cross hairs indicating the arrow is moving into the plane of the drawing. The infeed means 20 shown in FIG. 1A is used to provide gross motion of the web fabric from the input end of the forming machine to the center section whereupon an incremental transferring motion is imparted to the fabric to feed it to the awaiting gripping members. The infeed means is now described in detail with reference to FIGS. 1A, 2A and 4–6.

Figure 5:
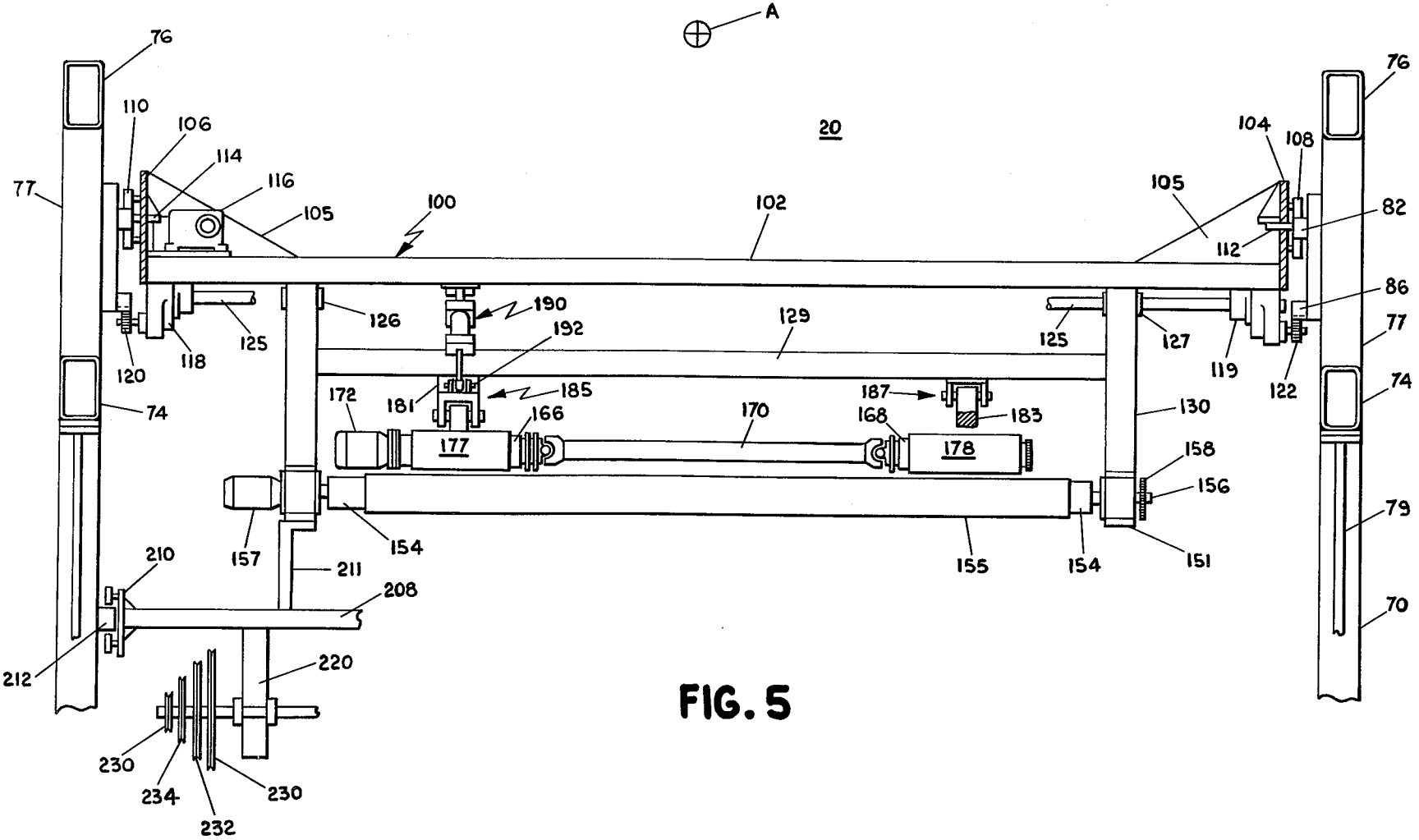
FIG. 5 is a fragmentary left end elevational view of the apparatus shown in FIG. 4.

The infeed means 20 comprises a carriage assembly 100 movably supported between guide rails 82 and 84. Carriage 100 comprises a pair of tubular support members 102 and 104 extending between upstanding end brackets 104 and 106 at opposite ends thereof. Cross braces 103 (FIG. 6) extend between members 102 and 104. Braces 105 reinforce these junctions at opposite ends. Extending from the outer face of each of the end brackets 104 and 106 are horizontally spaced pairs of vertically spaced guide rollers 108 which span the upper and lower surfaces of guide rail 82 and rollers 110 associated with bracket 106 which span the upper and lower surfaces of guide rail 84. A pair of horizontally oriented guide wheels 112 are coupled to end bracket 104 as seen in FIGS. 5 and 6 and similar wheels 114 are rotatably coupled to end bracket 106 and extend through slots therein such that carriage 100 captures three sides of each of the guide rails 82 and 84 to provide guided movement of the carriage along the guide rails with minimum friction and play.

A hydraulic carriage drive motor 116 is coupled between members 102 and 104 and is coupled to a gear reducing unit 118. The output shaft of unit 118 drives a first drive gear 120 associated with rack 88. A second drive gear 122 associated with rack 86 is driven through a drive shaft 125 coupled to gear box 118 and to gear box 119 associated with drive gear 122. Drive shaft 125 extends through sleeve bushings 126 and 127 mounted in downwardly depending support arms 128 and 130, respectively, of the carriage.

Arms 128 and 130 extend downwardly from arms 102 and 104 of carriage 100 to the movable clamping means 140. A cross member 129 (FIG. 5) extends between support arms 128 and 130. Means 140 consists of a lower platform 150 (i.e., first element) which is stationary with respect to arms 128 and 130 and an upper platform 160 (i.e., second element) vertically movable as indicated by arrow B in FIG. 4 to alternately engage and disengage platform 150 to clamp and unclamp the wire fabric 10 between the upper and lower movable platforms.

The lower platform 150 comprises forward and rearward end rollers 152 and 154, respectively, (FIGS. 5 and 6) which are horizontally spaced and rotatably mounted to the ends of end brackets 151 and 152 in turn coupled to arms 130 and 128, respectively. Bearings rotatably mount these rollers to the forward and rearward portions of the end brackets. Extending over and between rollers 152 and 154 is a relatively wide endless loop support belt 155 forming a movable support bed for the undersurface of wire fabric 10. Roller 154 is mounted on an axle 156 which is coupled to a hydraulic drive motor 157 (FIG. 5) at one end and includes a chain sprocket 158 at the opposite end. Roller 152 is mounted to axle 153 and includes a sprocket 159 which aligns and is coupled with sprocket 158 by means of an interconnecting drive chain 158′ (FIG. 6). Thus, drive belt 155 and both rollers 152 and 154 are driven by a single hydraulic drive motor 157. Drive motor 157 is controllably actuated to rotate belt 155 about rollers 152 and 154 to move the wire mesh 10 in a direction indicated by arrow A from the infeed means 20 as described below.

The upper movable clamping platform 160 comprises a pair of spaced forward roller members 162 and 164 and a pair of rearward roller members 166 and 168. Rollers 162 and 166 are rotatably coupled between brackets 161 and 163 by means of suitable axle and bearing means while rollers 164 and 168 are similarly mounted between end brackets 165 and 167.

A drive shaft 170 (FIG. 5) is coupled to rollers 166 and 168 and to drive motor 172 for rotatably driving rollers 166 and 168. Shaft 170 extends from an end of roller 168 remote from motor 172 terminating in a sprocket 174. A chain 175 (FIG. 6) engages a similar sprocket 176 mounted on shaft 173 extending through rollers 162 and 164 such that the single drive motor 172 actuates each of the four rollers associated with the upper platform. An endless loop belt 177 extends between rollers 162 and 166 while an endless loop belt 178 extends between rollers 164 and 168. Motor 172 is intermittently driven to rotate belts 177 and 178 in a direction opposite the lower platform belt 155 such that when the upper platform is in its clamping position, the wire fabric is driven through the infeed means in the same direction by the upper and lower movable clamping members.

In order to raise and lower the upper movable platform 160 between an unclamping and clamping position, respectively, a pair of brackets 180 and 182 extend between end brackets 161 and 163 and 165 and 167 respectively (FIG. 6). A pair of pivot arms 181 and 183 are each pivotally coupled at their lower ends to brackets 180 and 182, respectively, by means of a yoke interconnection 185 (FIG. 5). These arms are pivotally coupled at their upper ends to cross member 129 by means of a similar pivot connection 187. Such construction permits the pivotal movement of the upper movable platform 160 with respect to the lower movable platform 150. In order to raise and lower the upper movable platform, a cylinder 190 is pivotally coupled at its upper end to cross member 104 as best seen in FIG. 4 and has a shaft 191 which is pivotally coupled to arm 181 by pivot connection 192 (FIG. 5). Cylinder 190 is selectively actuated to lower or raise the upper movable platform 160 for clamping and unclamping the wire fabric between the endless loop belts.

Figure 12:
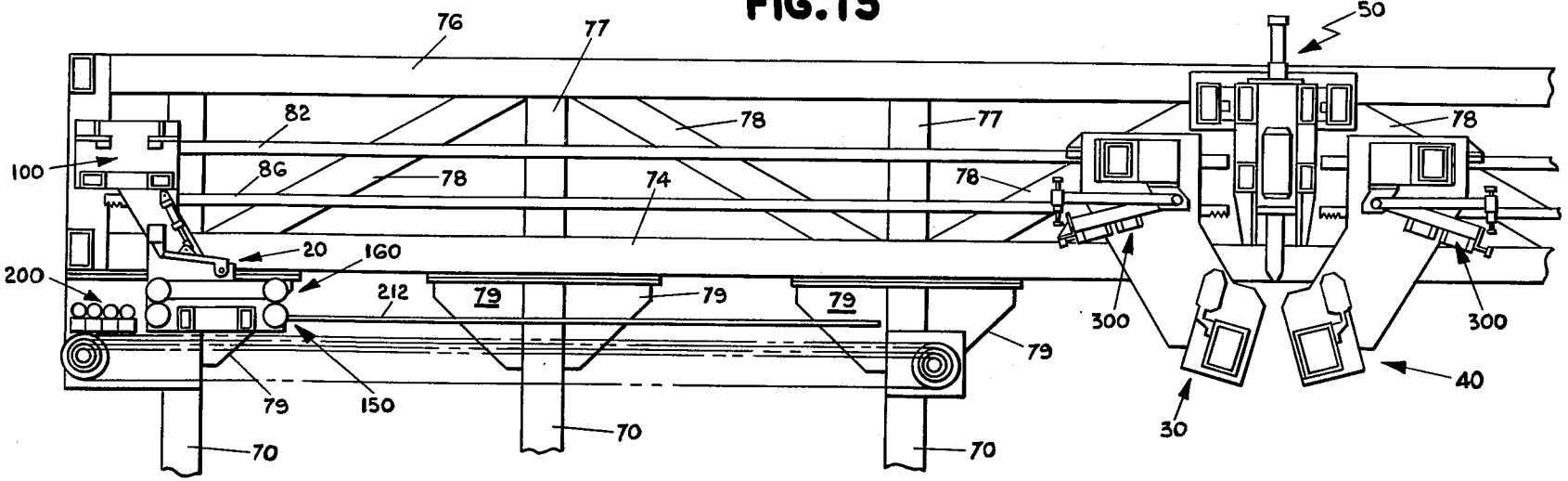
FIG. 12 is a fragmentary front elevational view of the apparatus of the present invention shown during one portion of a cycle of operation.
Figure 14A:
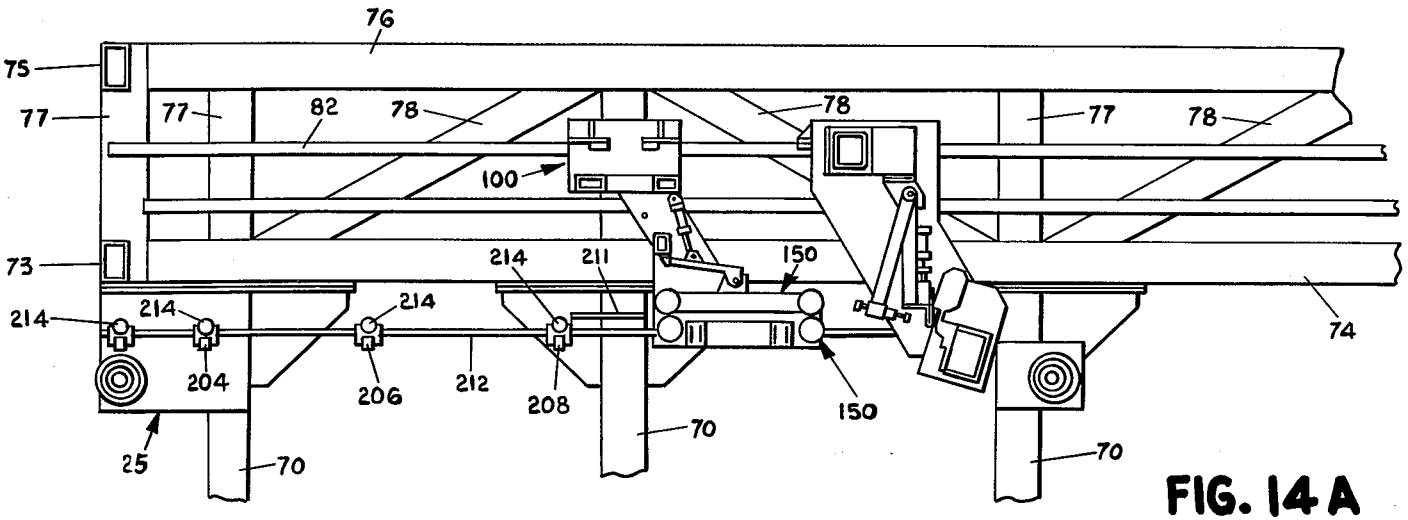
FIGS. 14A and 14B are fragmentary front elevational views of the apparatus of the present invention shown during a successive portion of a cycle of operation.
Figure 14B:
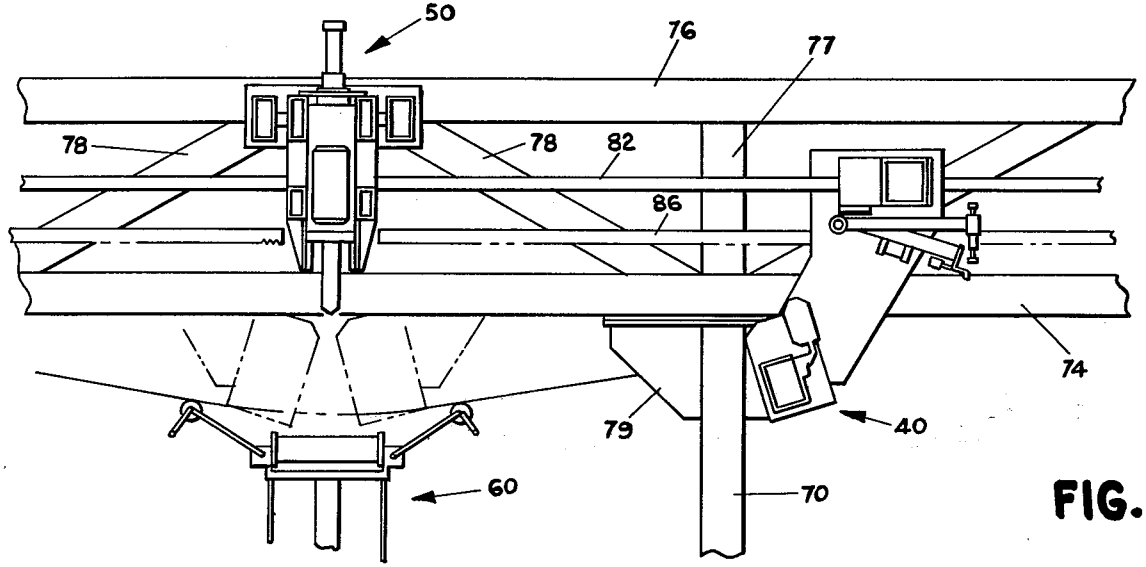

As the infeed means 20 moves from left to right as illustrated in FIGS. 12 and 13, a movable expandable support bed 200, coupled to the carriage, provides support for the trailing portion of the wire fabric. The construction of the movable support bed 200 is now presented with reference to FIGS. 4-6 and 12-14A.

The expandable traveling bed support structure comprises four channel-shaped cross members 202, 204, 206 and 208 which extend between end plates 210 at opposite ends of each of the cross members. Mounted to the vertical support stanchion 70 and extending longitudinally therealong on the inner side thereof on each side of the forming machine is a guide rail 212. Each of the end plates 210 includes upper and lower pairs of cam followers rotatably mounted to the end plates 210 for spanning each of the guide rails 212 in much the same fashion as the carriage 100 is mounted to guide rails 82 and 84. Thus, each of the cross members 202, 204, 206 and 208 is rollably supported along and between guide rails 212. Positioned on the upper surfaces of each cross member is a pair 214 of freewheeling conveyor rollers mounted thereto by conventional mounting brackets including bearings. The upper portion of the rollers 214 lie in the plane of travel of the wire fabric.

Four chains 220, 222, 224 and 226 are extended between pairs of associated sprockets 230, 232, 234 and 236, respectively, as best seen in FIGS. 5 and 13. Each set of the horizontally spaced sprockets is mounted and keyed to a rotatable axle 221 extending from brackets 225 at the left end and near the center of the forming machine. The sprockets are of progressively different diameters such that for a given motion of the outermost chain, the chains associated with the smaller sprockets will move a greater distance. Channel-shaped member 208 includes a clamping member 209 extending from its lower surface and coupling channel 208 to chain 222 which is the chain associated with the second largest diameter sprocket 232. Similarly, each cross member is coupled to an associated chain. Thus, member 204 is coupled to chain 226 via clamp 205 and member 206 is coupled to chain 224 via clamp 207 (FIG. 13).

Member 202 is coupled to the base of the machine via clamp 203 and is stationary. Chain 220 is further coupled to the carriage arm 128 by means of a bracket 211 (FIG. 5) such that as carriage 100 is progressively advanced toward the middle of the cage forming machine, the freewheeling rollers 214 mounted on the associated cross members are progressively advanced to expand in a uniformly, progressively spaced fashion to provide continuous support for the wire fabric as it is advanced to the middle section of the machine. Such construction, therefore, provides an expandable traveling support bed for the infeed means which provides continuous rolling support for the wire fabric and which expands and collapses as the carriage extends to advance to a fabric transferring position and retracts to receive a successive sheet of precut fabric.

GRIPPING ASSEMBLIES

Initially, it is noted that the gripping assemblies 30 and 40 are substantially identical with the exception that jaw assembly 30 includes a movable guide ramp 282 for guiding the leading end of wire fabric through the jaw assembly as it is transferred from the infeed means 20. Each of the gripper assemblies includes a pair of jaws one of which is movable with respect to the other for opening and closing the jaws for alternately receiving annd gripping the wire fabric. Both such jaws are rotatably mounted to a slide in turn slidably mounted to a carriage for motion along the guide rails of the forming machine. Each gripper assembly further includes combing means which can be retracted between inoperative and operative positions, which combing means are coupled to the slide and selectively actuated for combing the protruding free ends of the circumferential wires to assure their alignment with mating ends of corresponding circumferential wires as the cylindrical cage is formed. The comb means includes means for detecting the end of the wire fabric for controlling the advancement of the fabric into the gripping assembly and the subsequent combing operation. Having briefly described the common elements of each of the gripper assemblies, a detailed description of the gripper assemblies is presented in conjunction with FIGS. 7–11 and 16.

Figure 22:
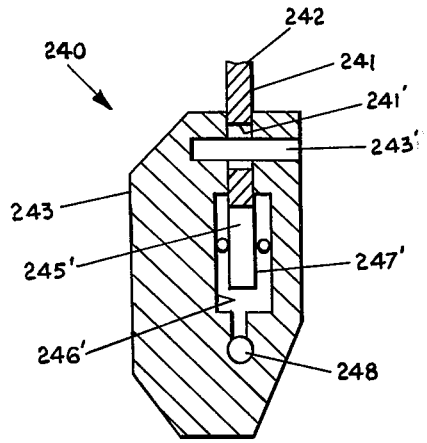
FIG. 22 is an enlarged cross section of one of the lower jaw members.

Each of the gripper assemblies includes a lower gripping jaw 240 which comprises a bar having a flat upper surface 242 which extends continuously between jaw end plates 244 and 246. The lower gripping jaw is bolted to a rectangular support channel 248, also welded between end plates 244 and 246. Each of the gripper assemblies also includes an upper gripping jaw 250 comprising an elongated bar having a gripping surface 252 facing the gripping surface 242 of lower jaw 240 and spaced slightly therefrom when in a closed position to accommodate the thickness of the wire fabric. As seen in FIG. 22, lower jaw 240 includes an elongated blade 241 fitted in an elongated slot in an elongated support bar 243. Blade 241 includes a plurality of oversized apertures 241' extending along the blade and through which extends a plurality of capture pins 243'. This mounting arrangement permits blade 241 to move in and out of member 243 in a limited fashion. Backing blade 241 on a surface opposite wire engaging surface 242 is a plurality of spaced pistons 245' mounted in spaced cylinder 246' formed in member 243. An O-ring seal 247' seals each of the pistons and associated cylinder walls. An elongated aperture 248 communicates with the lower end of each of the pistons and serves as a manifold to supply hydraulic fluid to force the pistons against blade 241 and apply a predetermined pressure against the wire fabric. This permits some compensating motion for the gripping jaws to accommodate any unevenness along the width of the fabric while still securely holding it in place.

Upper jaw 250 is pivotally mounted with respect to the lower jaw by a support member 248 and pivot mounting bracket 249 including a pivot pin 251 extending between an aperture in bracket 249 and an aperture formed in one end of the jaws 250. The opposite end of upper jaw 250 is rounded and includes a relatively large roller 254 mounted thereon for engagement by a hook-shaped jaw latch 256 which is pivotally mounted to a bracket 257 by means of pivot pin 258. The end of latch 256 remote from the concavely curved latching portion 255 is pivotally coupled to a latch cylinder 260 by means of a pivot connection 262 coupling the end of the latch to cylinder shaft 264. The remote end of latch cylinder 260 is pivotally coupled to support member 248 at pivot connection 265.

Figure 20:
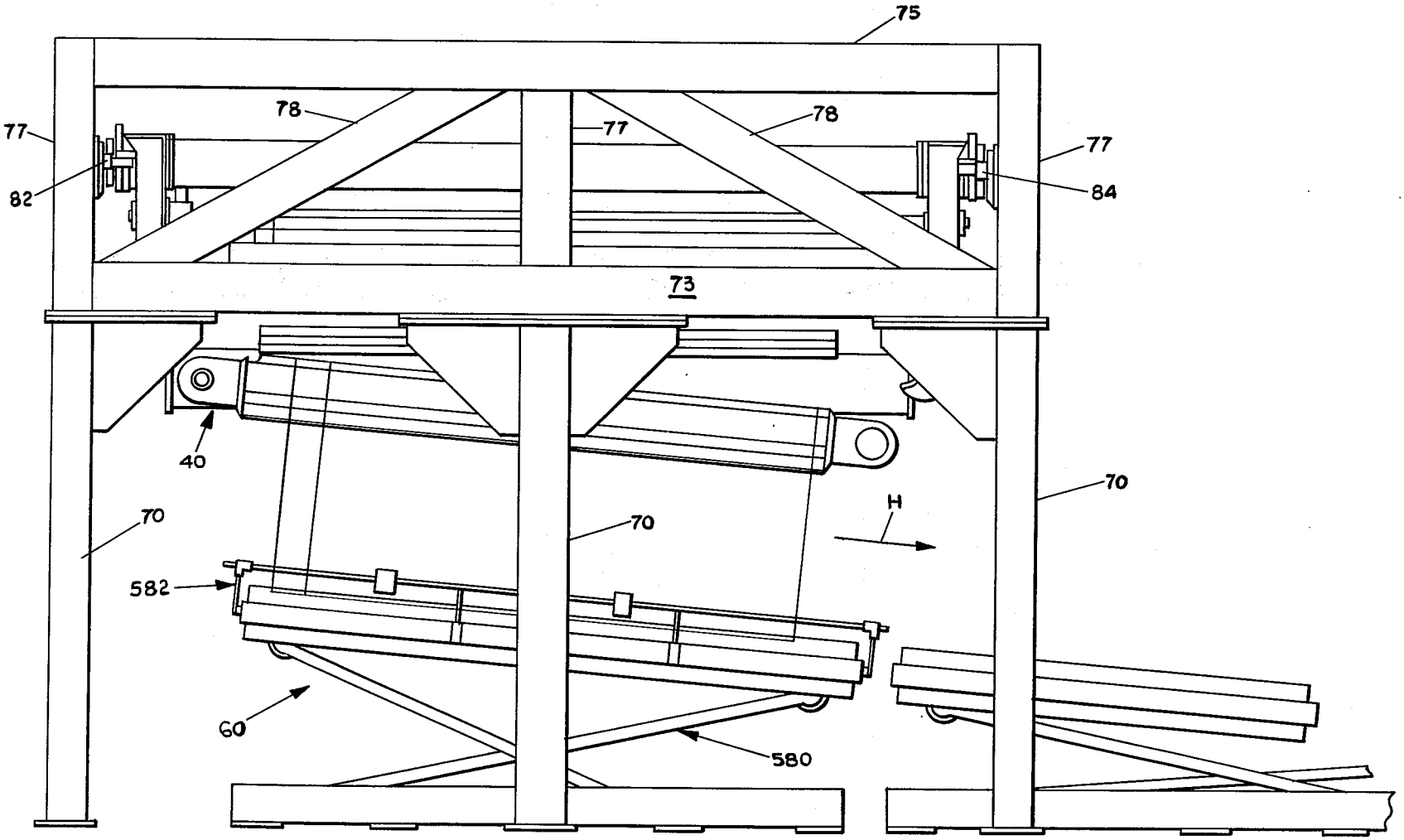
FIG. 20 is an enlarged right end elevational view of the apparatus of the present invention showing the outfeed means.

The pivot end of jaw 250 includes a bell crank 266 coupled to the upper jaw at its pivot connection and pivotally coupled at its remote end to shaft 268 of upper jaw actuating cylinder 270. The end of cylinder 270 remote from pivot connection 267 with crank arm 266 includes a pivotal coupling 272 to support member 248. Thus, by actuation of cylinders 260 and 270, upper jaw 250 can be opened for removal of a wire cage therefrom as shown in FIG. 20 (in which the upper jaw has been rotated to a lower position) or closed and locked in position by latch 256 for securely holding the ends of the wire fabric during the forming and welding steps.

Jaw end plates 244 and 246 include stub axles 245 and 247, respectively, extending outwardly therefrom and through downwardly depending end plates 274 and 276 of slide 280. A commercially available rotary actuator 275 is coupled to shaft 245 (FIG. 11) and is mounted to end plate 274 and is actuated for rotating the upper and lower jaw members during the forming operation as described in detail below. Stub shaft 245 includes a splined connection with rotary actuator 225 permitting axial motion of the upper and lower jaws in a direction indicated by arrow C in FIG. 11. Stub shaft 247 extends into and communicates with a rotating cylinder 253 mounted to end plate 276 and actuatable for providing incremental motion as indicated by arrow C which is utilized to shift one end of the wire fabric with respect to the stationary remaining end of the wire fabric. As will be described in greater detail below, as the wire cage is made, the extending circumferential wire ends are initially skewed with respect to each other so that as the cylindrical cage is made, the wire ends will not interfere with each other. Once the cylinder is formed, however, it is desired to make 100% upset weld thus necessitating the axial shifting of one of the ends of the wire fabric such that the free ends of the circumferential wire will be aligned with and in contact (i.e., abutted) with each other. This is achieved by actuating cylinder 253 which engages stub shaft 247 for shifting the jaws of gripper assembly 40 an incremental distance.

Before describing the slide and carriage construction for each of the gripper assemblies, a description of the movable guide ramp for assembly 40 is presented followed by a description of the combing mechanism for straightening the free ends of the circumferential wires. As noted above, the guide ramp assembly is required only in the left end gripping assembly 30 through which the leading end of wire fabric advances into the forming machine.

Figure 7:
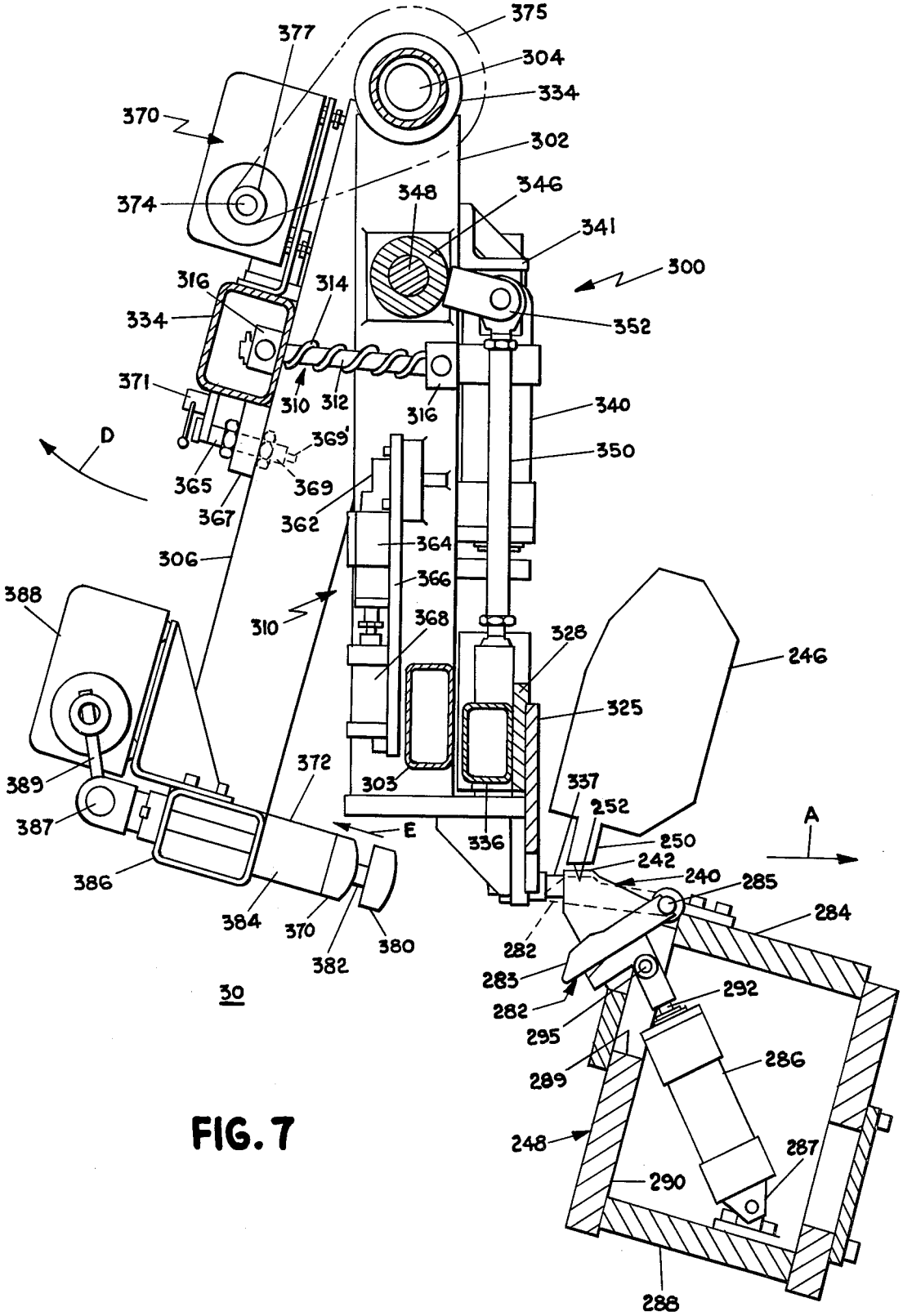
FIG. 7 is an enlarged front elevational view partly in cross section of one of the gripper assemblies shown in FIGS. 1 and 2 showing the combing means associated therewith in detail.

The lower jaw member 240 includes at least three notches which accommodate movable guide arms 282 as best seen in FIG. 7. Each ramp arm 282 includes a tapered leading edge 283 which when the arm 282 is pivoted to its raised position (shown in phantom form in FIG. 7), engages a transverse wire of the incoming wire fabric to guide the fabric between the open gripper jaws. Arm 282 is pivotally coupled to the upper plate 284 of support member 248 by means of pivot coupling 285. Each arm is coupled to an actuating cylinder 286 mounted within support box 248 by means of a pivotal coupling 287 mounted to the inner surface of floor 288 of box 248. A slot 289 is provided in the forward wall 290 of box 248 permitting cylinder shaft 292 to extend therefrom and be pivotally coupled to arm 282 by means of pivot connection 295. In FIG. 7, the ramp is shown in its normally lowered position in solid lines and is shown in phantom form in its momentarily raised position upon actuation of cylinder 286 prior to the transfer of wire fabric into the gripping assemblies from infeed means 20. Once the wire fabric has advanced through gripper assembly 30 and into gripper assembly 40 (which does not require a guide ramp since the wire fabric is entering in an opposite direction as shown in the gripper assembly 30 of FIG. 7) and is detected by gripper assembly 40, the guide arms 282 are lowered by the deactuation of cylinders 286 associated therewith.

Each of the gripper assemblies 30 and 40 includes a comb assembly 300 which can be pivoted and raised out of the way of the gripping jaws during the forming operation as seen in FIG. 12 and which are lowered to provide the combing of the free ends of the circumferential wires as well as providing a reference for controlling the position of the fabric in the gripping assemblies. While the combing assemblies are substantially identical, their operation with respect to the wire cages are different. A description of the detailed functioning of the comb assemblies will be deferred until the subsection OPERATION below. A detailed description of the construction of each of the comb assemblies, however, is now presented with reference to FIGS. 7, 8 and 11.

Each of the comb assemblies 300 includes a plurality of spaced comb supporting arms 302 rigidly secured to a shaft 304 which is pivotally mounted between slide end plates 274 and 276. Pivotally mounted on shaft 304 to provide relative motion between itself and arm 302 is a plurality of spaced drive arms 306. Arms 302 and 306 are biased in a spread position by means of at least a pair of spaced spring block couplings 310 including a coupling rod 312 (FIG. 7) circumscribed by a compression spring 314 extending between pivotable mounting blocks 316. Cross support 334' extends between arms 306. Shaft 312 is permitted to extend through one of the mounting blocks 316 such that when arm 306 is moved toward arm 302, shaft 312 can extend therethrough. Arms 302 and 306 are simultaneously moved by a rotary drive 320 mounted to the end of shaft 304 on the side opposite end support 276 and shown in phantom form in FIG. 11. Thus, each of the comb assemblies 300 can be rotated in an out of the way position by actuation of rotary drive 320 to rotate the assembly in a direction indicated by arrow D in FIG. 7 during the forming operation.

When in its lowered and operative position as shown in FIG. 7, however, arm 302 is substantially vertically extending such that a multiple tooth comb plate 325 having a plurality of teeth 326 formed along the lower edge can be lowered to engage the circumferential wires. Comb plate 325 is mounted to a backing plate 328 which is slidably supported at opposite ends for vertical motion about vertically extending shafts 329 by means of sleeves 330. Shafts 329 are supported on arms 302 rotatably coupled at the upper end to shaft 304 by means of sleeve 334. Arms 306 extend upwardly and are secured to shaft 304 by means of sleeve 339 keyed to the shaft.

The comb 325 is raised and lowered by means of a pair of comb cylinders 340 positioned at opposite ends of the comb plate 328 and including rods 342 pivotally coupled to the comb plate 328 by means of a pivotal joint 344. The end of each cylinder 340 remote from shaft 342 is pivotally coupled to a bracket 341 by means of pivot connection 343. Bracket 341 in turn is secured to arm 302. A sleeve 346 surrounds a journal 348 and serves as a torque shaft for two pivot rods 350 spaced at two extremes of comb support plate 328 to assure uniform raising and lowering of comb 325. Each of the pivot rods 350 is pivotally coupled at an upper end to sleeve 346 by pivot coupling 352 and at a lower end to the comb plate 328 by pivot coupling 354.

Figure 8:
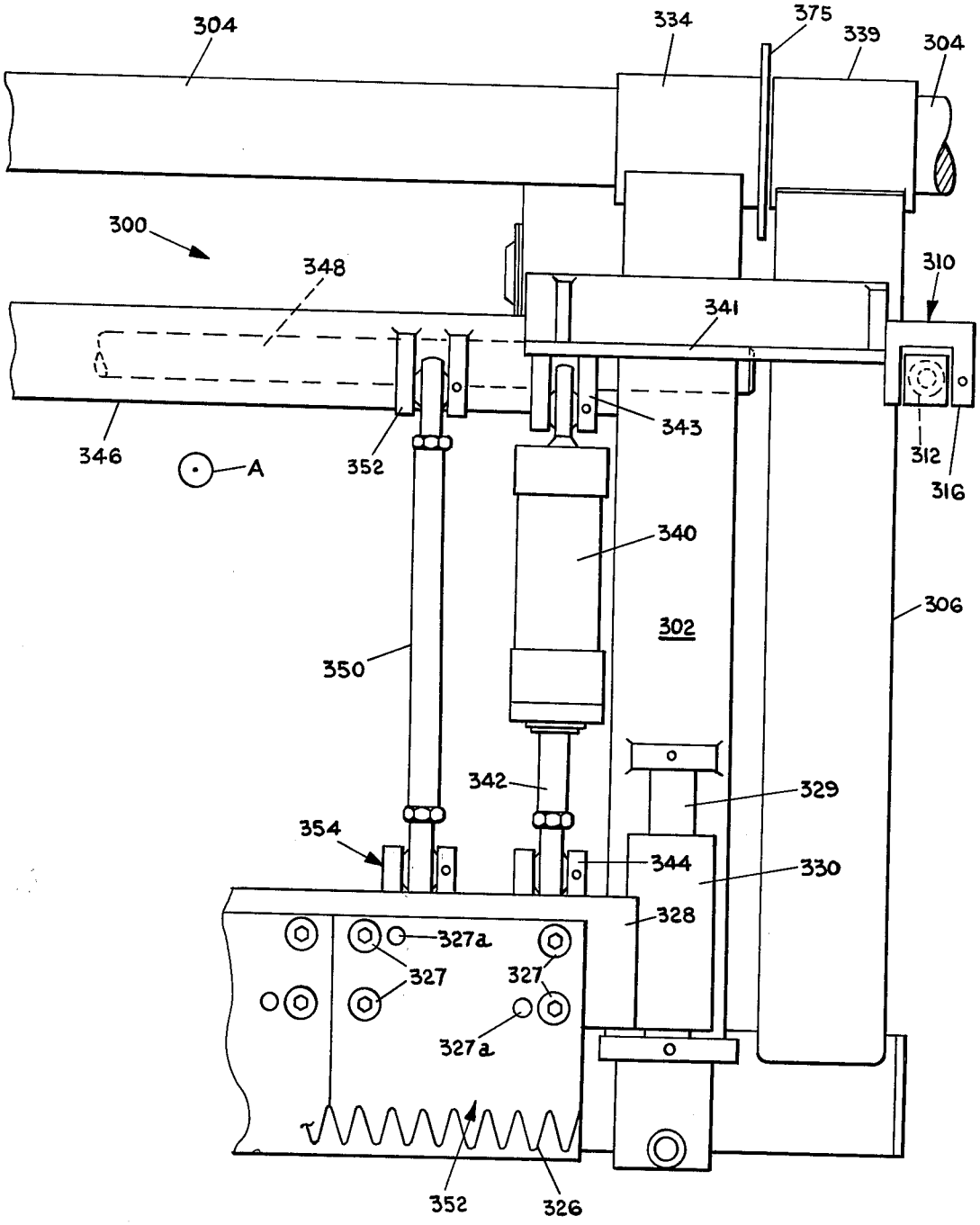
FIG. 8 is a fragmentary right end elevational view of the combing means shown in FIG. 7.

It is noted here that the comb teeth 326 shown in FIG. 8 are selected to converge at an angle of approximately 60° and have sufficient depth such that they engage standard mesh wire fabric and straighten circumferential wires as described below even through the circumferentially extending free ends are relatively bent initially. As the wire mesh varies significantly with different wire fabrics, it may required that the comb plate 325 be changed. To facilitate changing the plate, a plurality of bolts 327 and dowels 327a are employed to secure the comb plate to the backing support plate 328. To assure reproducible and proper registration of the wire fabric with respect to the gripping jaws during the combing operation, each end of the comb 325 includes a stop 333 which engages a projecting stop 337 (FIG. 7) associated with the lower jaw 240 of the gripping assembly to assure correct registration during the combing operation.

The support arms 302 include a two-position stop 360 comprising a step cut block 362 coupled to a carriage 364 slidably supported on the bracket 366 and movable by cylinder 368 as seen in FIG. 7. An adjustable stop 365 is threaded through block 367 attached to arm 306 and includes end 369 which engages the step cut block 362 depending upon the actuation of cylinder 368, to provide a greater or lesser angular spacing between arms 302 and 306. This compensates for two sizes of wire fabric where a greater extension is required on the extending free ends of circumferential wires for prebending the wires to form the cylindrical cage. This also accommodates different amounts of overlap required for welding different wire sizes. A limit switch 371 is actuated by a plunger 369' extending through stop 369 to provide a signal indicating when the wire fabric is registered.

Drive arm 306 includes a programmable rotary limit switch unit 370 for detecting the angular relationship between arms 306 and 302 and providing a control signal representative thereof to control the actuation of rotary drive 320. Unit 370 includes a plurality of limit switches and having a rotary shaft 374 on which there is provided a plurality of cams for sequentially actuating the limit switches within unit 372 as the angular relation between shafts 302 and 306 changes. Shaft 374 is coupled to sprocket 375 (FIGS. 7 and 8) mounted to collar 334. A chain 376 (FIG. 7) couples sprockets 375 and 377 such that a change in angular position between arms 302 and 306 will rotate shaft 374.

Additionally, drive arms 306 include means for detecting the end of the wire fabric and for engaging the wire fabric for squaring the fabric. The detecting means includes a shoe 380 having a shaft 382 extending through a sleeve 384 mounted to a cross support member 386 extending between the spaced arms 306. The end of shaft 382 is coupled to a multiple position limit switch 388 by a pivot connection 387 and arm 389. As the wire fabric engages the contact shoe 380, it will move rearwardly actuating limit switch 388 which provides control signals for controlling the motion of the means feeding the wire fabric. Shoe 380 fits within a recess formed in a continuous pusher block 390 which extends across the length of the combing assembly 300 and which is mounted to a backing plate 392 also secured to cross channel member 386.

Once the edge of the wire fabric has been detected and shoe 380 pushed rearwardly as indicated by arrow E in FIG. 7, limit switch 388 generates an additional signal initiating deceleration of rotary actuator 320 (FIG. 11) for advancing drive arm 306 and comb support arm 302 in a direction opposite arrow D in FIG. 7 while pushing the wire fabric (in one instance) until the comb plate 333 prevents further rotation of arm 302. At a point determined by signals from limit switches 388 and 370, the comb 325 is lowered such that it misses the last transverse wire. As arm 306 continues swinging in an arc, the wire fabric is forced between the teeth of the now lowered comb 325 straightening the free ends of the cimcumferential wires. Thus, the comb assembly 300 includes not only combing means but means for providing relative motion between the wire fabric and the combing means and means for detecting the ends of wire fabric for controlling its motion through the machine. Having described the structure of the combing assembly and briefly described its operation, the continued description of the gripper assembly slide and carriage is now presented in conjunction with FIGS. 9–11.

The slide and carriage assemblies 280 and 380', respectively, (FIG. 11) comprises an external slide movably mounted with respect to the internally positioned carriage. The slide comprises upper and lower plates 400 and 402 each secured at opposite ends to slide end plates 274 and 276. Plates 400 and 402 are vertically spaced and supported along opposite edges by a plurality of vertically extending support members 404. This construction defines an interior space in which the carriage cross member 410 is positioned. Cross member 410 comprises a pair of rails 412 joined by support members 414. Rails 412 are spaced from each other to permit clearance in a horizontal direction of about 2 inches between the outer edges of rails 412 and vertical support members 404 of the slide.

Plates 274 and 276 include relatively large apertures (not shown) permitting the rails to extend outwardly therefrom without contacting the slide end plates and terminating in carriage end plates 414 and 416. Between the carriage cross member 410 and the slide plates 400, 402 and slide end plates 274 and 276, there is positioned a plurality of air bearings of two varieties. First, there is a plurality of elongated air bearings 418 interposed between which there is provided circular adjustable air bearings 420. To provide lateral support preventing shifting of the slide with respect to the carriage cross members, air bearings are also provided on each of the end walls of the slide assembly. Air bearings 418 and 420 are positioned on both the upper and lower surfaces of the carriage cross member such that the carriage cross member is slidably held within the slide plates 400 and 402 and provided with an interengagement approaching zero friction at the upper and lower surfaces and along the end walls such as cross brace 414*a* (FIG. 10) with respect to end plate 274. A suitable source of air pressure (not shown) is coupled to each of the air bearings which are commercially available from the Air Float Corporation of Decatur, Ill.

Figure 10:
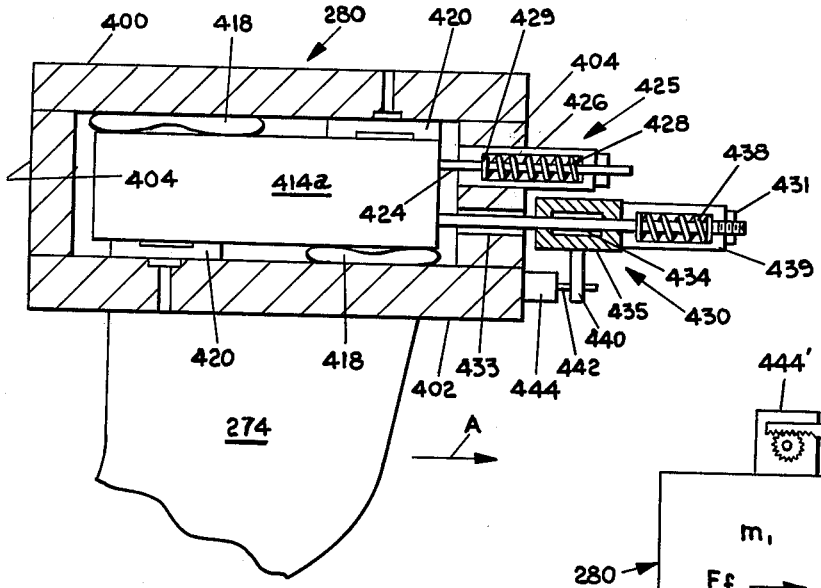
FIG. 10 is a cross section of the gripper assembly slide and carriage taken along section lines X—X in FIG. 11.
Figure 9:
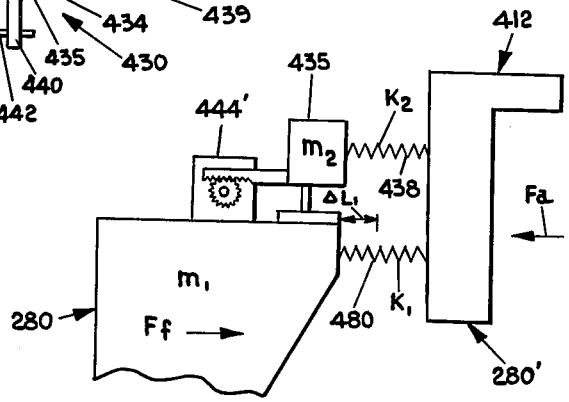
FIG. 9 is a schematic view of the gripper assembly slide and carriage.

Intercoupling the slide assembly and the carriage cross member is at least a pair of spring interconnections 425 (FIG. 10). Unit 425 includes a shaft 424 secured to the carriage cross member and slidably extending into a housing 426 secured within an aperture of one of the vertical extending support members 404 of the slide. A spring 428 having a spring constant $K_1$ engages the housing 426 and a thrust washer 429 mounted to shaft 424 to couple cross member 410 to the slide by means of a spring 428. The construction of unit 425 is disclosed in greater detail in U.S. Pat. No. 3,543,609 issued Dec. 1, 1970 to D. J. Borodin in FIGS. 24 and 25 of such patent, incorporated herein by reference. It is noted that only one unit 425 is shown. In the preferred embodiment, two or more spring coupling units spaced along the edge of each of the gripping members spring couple the slide to the carriage cross member.

In addition to the spring coupling, means for detecting the acceleration of the carriage assembly and the slide is provided. The acceleration detection means 430 comprises a shaft 432 coupled at one end to the carriage cross member 410 and extending through an aperture 433 in support 404. Slidably coupled to the extension of shaft 432 outside of the slide by means of a cylindrical air bearing 434 is a seismic mass 435. Air bearing 434 is coupled to a pressurized source of air (not shown). The seismic mass is seated against a thrust washer 436 against which a spring 438 having a spring constant $K_2$ and surrounding shaft 432 is positioned. Spring 438 is positioned within a housing 439 secured to a threaded end of shaft 432 by means of nut 431. Spring constant $K_2$ is related to spring constant $K_1$ as described below.

Coupled to a downwardly extending leg 440, which is a part of seismic mass 435, is the shaft 442 of a motion sensing device 444 secured to the slide 280. Sensor 444 can be a linear voltage differential transformer or other suitable sensing device which will provide an output signal directly related to the relative motion between the seismic mass 435 and the slide. This signal is utilized to control the acceleration of the carriage assembly as described below in conjunction with FIG. 9. Before discussing this aspect of the system, however, the carriage drive is discussed in conjunction with FIG. 11.

Figure 11:
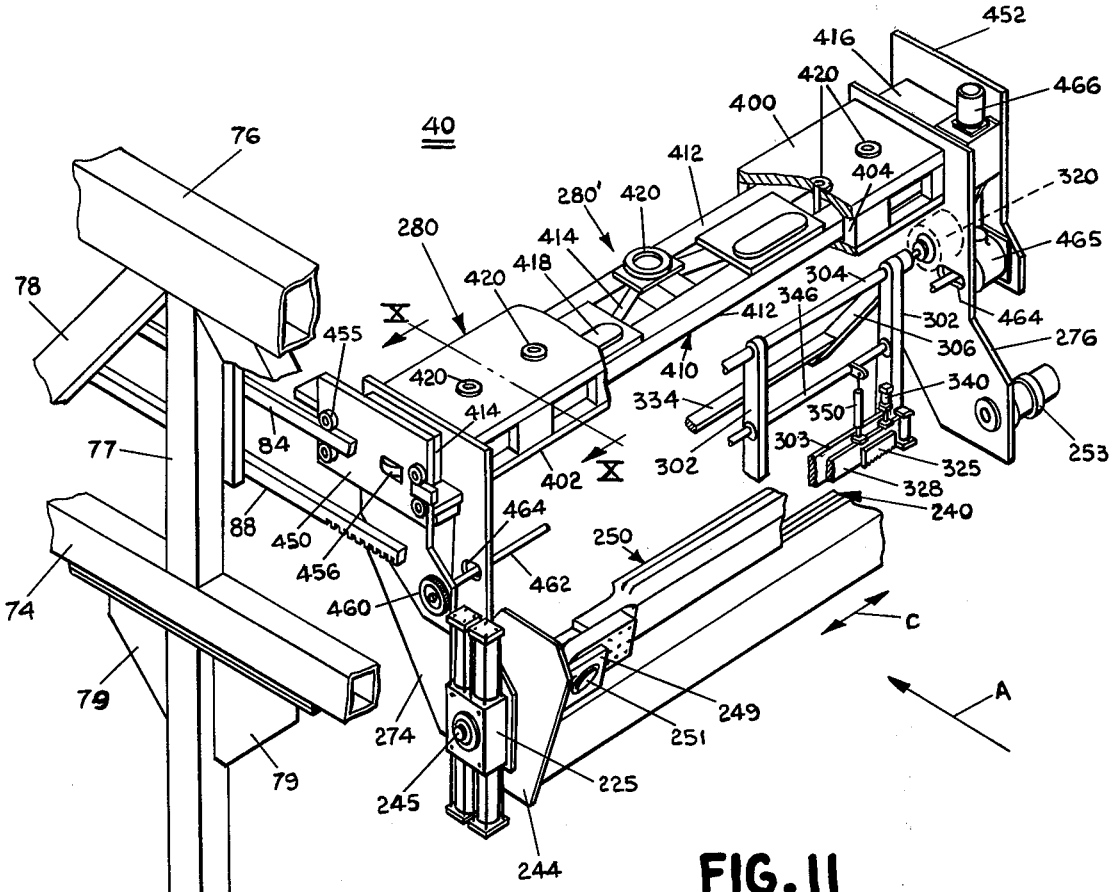
FIG. 11 is a fragmentary front perspective view partly broken away of one of the gripper assemblies.

The carriage end plates 414 and 416 are secured to carriage slide plates 450 and 452, respectively, which in turn are rollably coupled to guide rails 84 and 82, respectively, of the machine support structure as best seen in FIG. 11. Plate 450 includes two pairs of vertically spaced rollers 455 which span the upper and lower surfaces of guide rail 84 and a pair of horizontally oriented and spaced rollers 456 engaging the inner surface of guide rail 84. Plate 452 includes a similar construction for engaging guide rail 82. The carriage is driven by means of drive gears 460 at opposite ends of a drive shaft 462 and which are positioned to engage teeth 89 of drive rails 86 and 88. The drive shaft 462 extends through elongated apertures 464 in slide end plates 274 and 276 (to permit relative motion between the slide and carriage without interference) and terminates in a transmission 465. Transmission 465 includes a right angle drive and is driven by a variable speed hydraulic motor 466 which receives drive signals controlled in part by the output of sensor 444 for controlling the motion of the gripper assembly on which it is mounted. Each of the gripper assemblies includes similar drive and control structure. Having described the construction of the slide and carriage assembly, a description of the function and control of this unique structure is provided in conjunction with FIG. 9.

Figure 15:
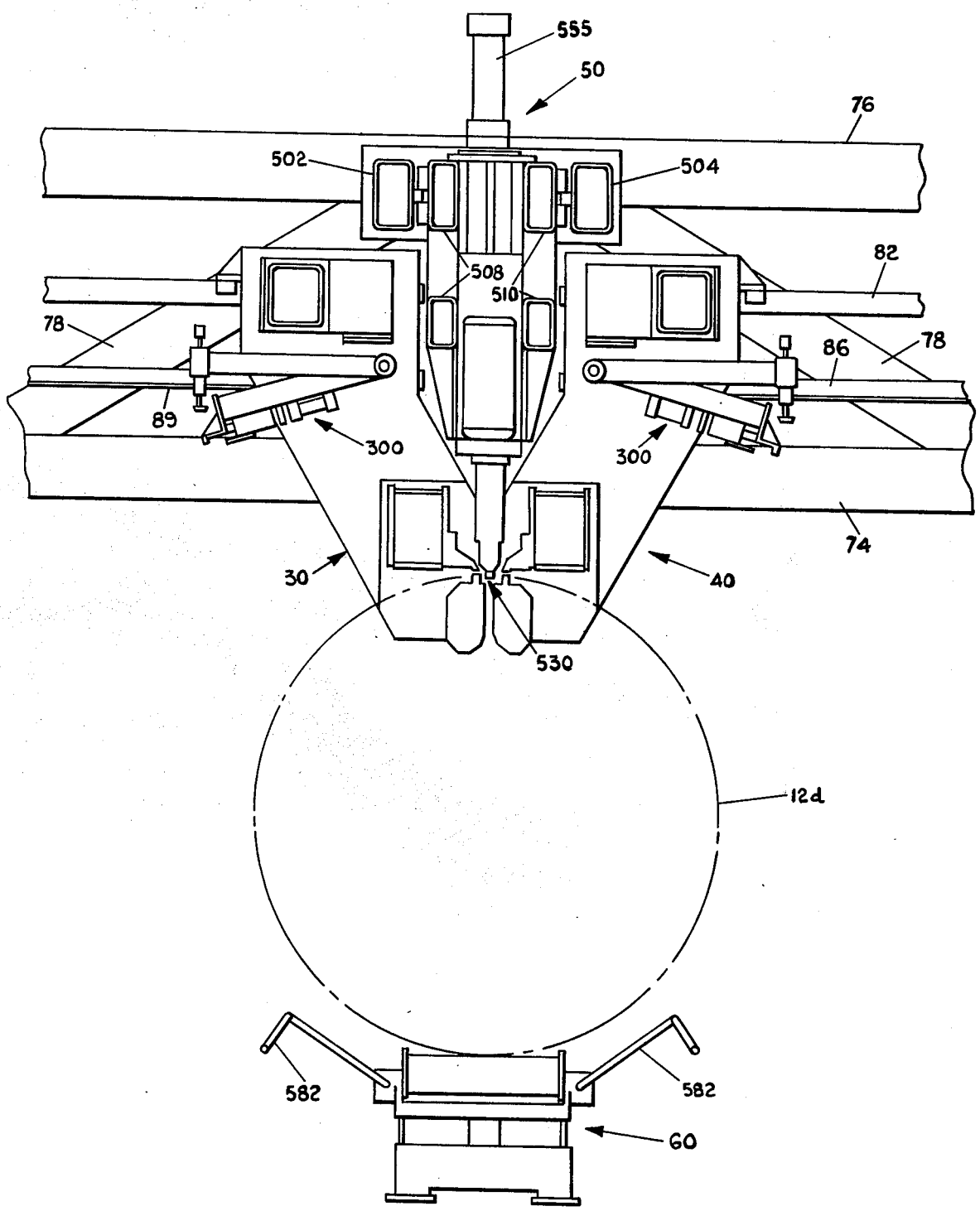
FIG. 15 is an enlarged fragmentary front elevational view of the apparatus of the present invention shown during a successive portion of a cycle of operation.
Figure 16:
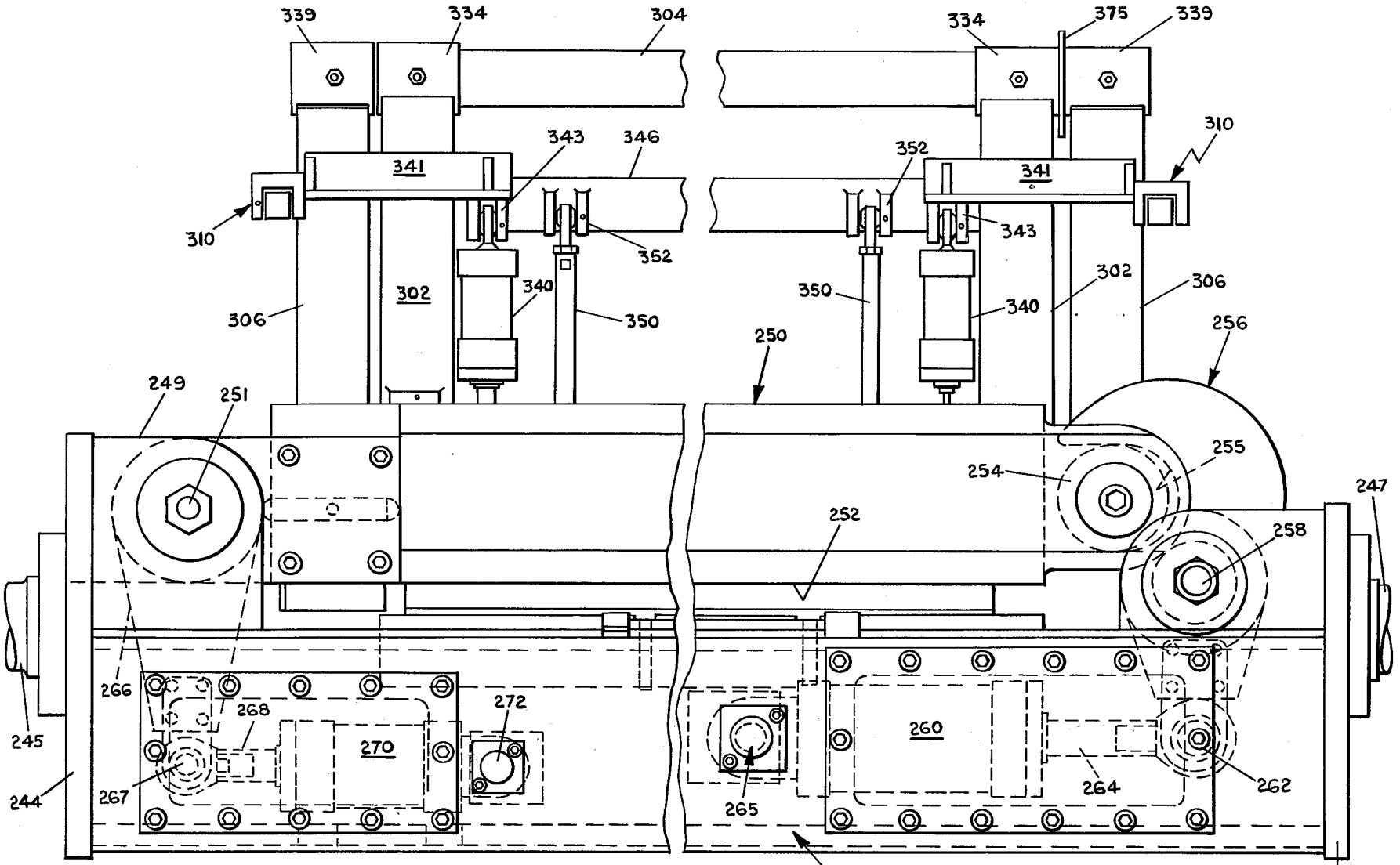
FIG. 16 is a fragmentary front elevational view of one of the gripper assemblies.

Initially, it has been discovered that if material to be formed into a circle is gripped at opposite ends by gripping members which are free to rotate without resitance, as the ends are brought together along a straight line in the same plane, a perfect circle is formed. This assumes, of course, that the material is free to deflect out of the plane of the ends held by the gripping members. In order to utilize this discovery in the present apparatus where it is desired to form a cylindrical wire fabric cage held in position for subsequent welding, it has been determined that the carriage drives should be positively driven in synchronism with rotation of the gripping members such that at each point of travel the cage will have a true circular shape. The gripping members should be positively rotated in synchronism with the carriage drives for each of the gripping members such that as the gripping members arrive at the midpoint as shown in FIG. 15, the gripping jaws will have rotated 180° forming the completed circular cross section construction.

Should the cage deviate from a circle during the forming process, a resistive linear force component is exerted on the slide assembly on which the gripping members are mounted. This force is directly related to the resistance to translation of the slide due to the natural tendency of the material to assume circular shape and is converted into relative motion between the slide and carriage which can be detected by the inertially responsive detecting means. The sensor output signal is employed to change the carriage speed of both of the gripping assembly carriages to compensate for the momentary tendency of the material to form anything other than a perfect cylinder. In order to generate a signal which is directly proportional to the resistive force of the fabric and, therefore, the deviation of the forming of the fabric from a perfect circle or cylindrical shape, the spring constants $K_1$ and $K_2$ are chosen with respect to the seismic mass and mass of the slide assembly to satisfy the following equation with respect to the elements identified in FIG. 9:

$$K_2 \div K_1 = m_2 \div m_1$$

Assuming a frictionless system, which is certainly true of the seismic mass, which is mounted on air bearings and is virtually true of the slide which has a relatively high mass and, therefore, its accelerational force will be much greater than any frictional force which is insignificant. Thus, the following relationship exists between the slide and seismic mass: Deflections due to acceleration $$\Delta L_2 = \frac{F_2}{K_2} = \frac{m_2 a_2}{K_2}$$

$$\Delta L_1 = \frac{F_2}{K_1} = \frac{m_1 a_1}{K_1}$$

but because $$m_1/m_2 = (K_1/K_2)$$

$$K_2 = K_1 \left(\frac{m_2}{m_1}\right)$$

therefore $$\Delta L_2 = \frac{m_2 \times a_2}{K_1 \left(\frac{m_2}{m_1}\right)} = \frac{m_1 a_2}{K_1}$$

since $$a_1 \rightarrow a_2 (m_1 a_2/K_1) \rightarrow (m_1 a_1/K_1)$$

Hence deflections due to acceleration are equal.

The purpose of the mechanism 430 is, therefore, to cancel out the effect of the acceleration in the reading of the deflection. The remaining deflection registered by sensor 444 is essentially due to the force produced by the cage due to its deviation from a perfect circle at any point during the forming cycle.

$F_T$ = total force acting on spring 428 = $Fc + F_2$
where $F_c$ = force exerted by cage
$F_2$ = force due to acceleration
$F_1$ = force acting on seismic mass due to acceleration
$\Delta L_T$ = total deflection of spring 428 = $\Delta L_1 + \Delta L_c$
where $\Delta L_c$ = deflection due to cage
then $\Delta L_T - \Delta L_1 = \Delta L_c$
$= \Delta L_T - \Delta L_2 = \Delta L_c$ This relative motion is detected by the LVDT sensor 444 (FIG. 10) or a Servalve sensor 444' (schematic FIG. 9) and converts such motion into an electrical signal which can be employed to control the speed of the carriage through the drive motor 466 (FIG. 11). The feedback of the force $F_c$ through the deflection detected by sensor 444 enables the maintenance of the proper relationship between the angular position of the grippers and that of the carriage. An accelerometer also could be coupled to the slide to detect the acceleration of the slide and employed to develop a signal together with a load cell coupled between the slide and carriage in place of spring 428. The difference in the output signals would then be employed to provide the speed control signal for the carriage.

Thus, given any length of wire fabric, the gripping assemblies are moved toward each other while the gripping jaws are rotated 180° in synchronism to form a perfect circle with self-compensation for any out of synchronism condition caused by the gripper jaw slide being in advance or behind the rotational motion of the gripping jaws, which condition deviates from the locus of points of the wire when a cylinder is being formed. The control system which operates as an inertia detection system, can be employed to automatically adjust the motion of gripping jaws to form the fabric into a perfect cylinder regardless of the fabric length, the stiffness or the like. Although the parameter control in the preferred embodiment is the speed of the slide, it is readily apparent that the rotational drive for the gripping jaws likewise could be speeded up or slowed down to compensate for the asynchronous motion between the jaws and their slides. Also, the control system can be used in machines for forming single wire circiles or cylinders from any deformable planar stock.

Figure 17:
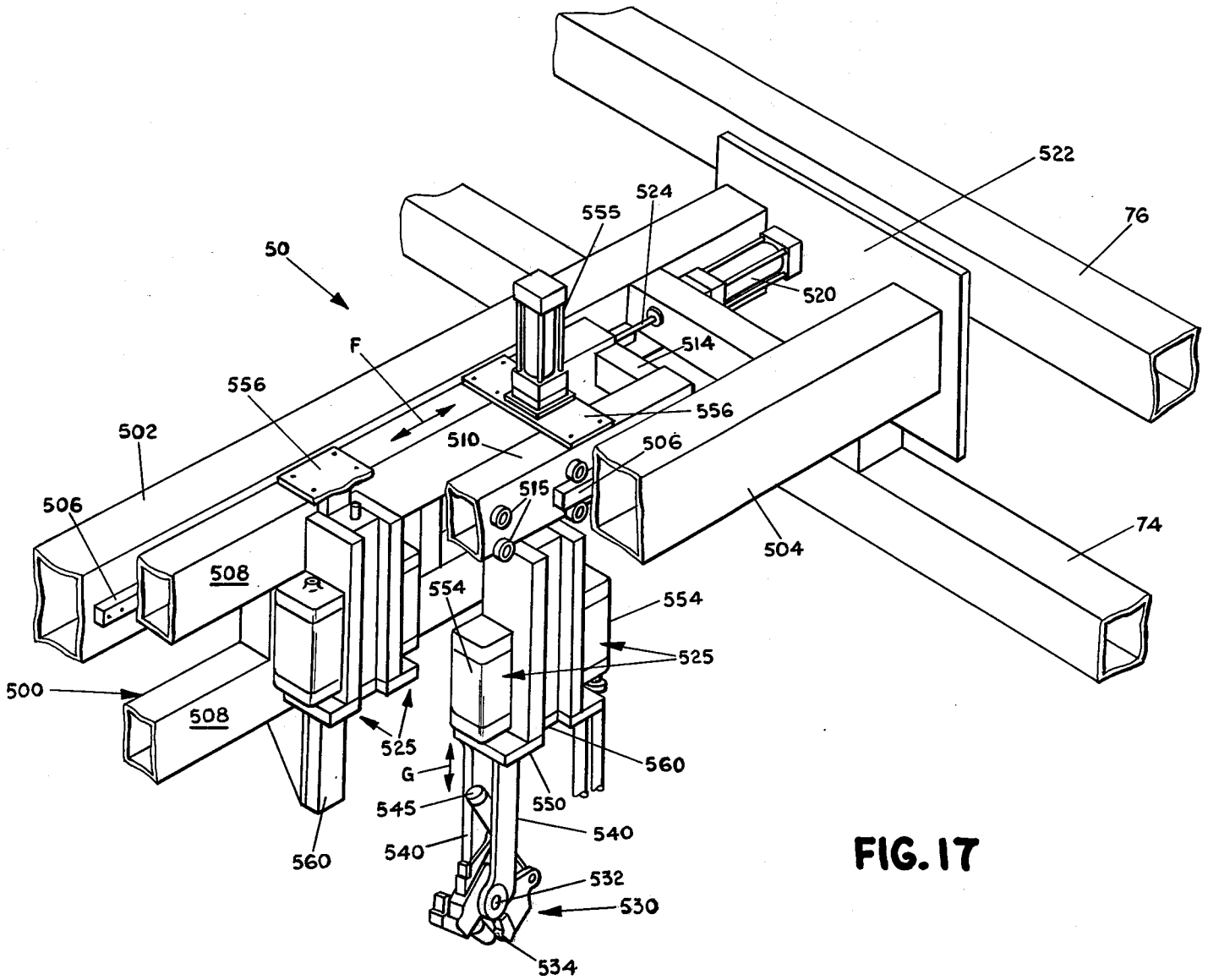
FIG. 17 is an enlarged fragmentary perspective view partly broken away of the welding apparatus of the present invention.
Figure 18A:
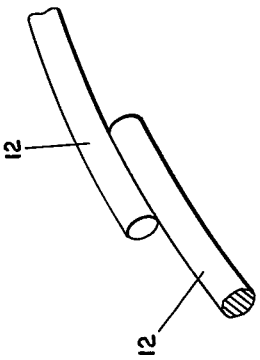
FIG. 18A is a fragmentary perspective view of the overlapped juxtaposed circumferential wires prior to welding.
Figure 19A:
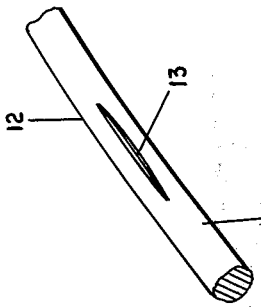
FIG. 19A is a fragmentary perspective view of the welded wire junction.
Figure 18B:
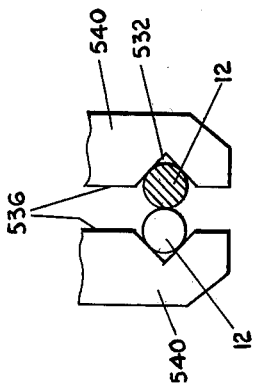
FIG. 18B is an enlarged fragmentary view of the electrode jaws of the welding apparatus showing the relative position of a pair of wires to be welded.
Figure 19B:
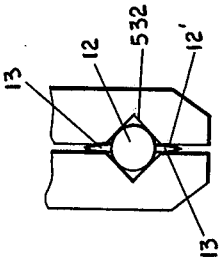
FIG. 19B is an enlarged fragmentary view of the jaws of the welding apparatus after the welding has been completed.

Once the gripper assemblies 30 and 40 have advanced together to a position shown in FIG. 15, the free ends of the circumferential wires are overlapped and once adjusted to lie immediately adjacent each other by the actuation of cylinder 253 as described above in conjunction with FIG. 11, the cage is in position for welding by the welding apparatus 50 as best seen in conjunction with FIGS. 17–19 now described.

Initially, it is noted that upset welding with orthogonally oriented wires is known. To distinguish the unique welding method and apparatus of this invention, the term "line upset weld" is employed. This term thus refers to the longitudinal alignment of the ends of the circumferential wire providing a line contact therebetween before welding. The resultant line upset weld can be complete (100%) as shown in FIG. 19A or partial to join the wire ends.

The welding unit 50 as best seen in FIG. 17 comprises a carriage 500 movably mounted between transverse support members 502 and 504, each of which includes a guide rail 506 on facing surfaces thereof. Carriage 500 includes a pair of support beams 508 and 510 having a plurality of pairs of vertically spaced rollers 515 which span upper and lower surfaces of the guide rails 506 on beams 502 and 504 for providing support for carriage 500 permitting its motion along these beams as shown by arrow F in FIGS. 2B and 17. For actuating carriage 500 there is provided a hydraulic cylinder 520 mounted on backing plate 522 in turn attached to the support beams 75 and 76 on opposite sides of the forming machine.

Cylinder 520 includes shaft 524 extending therefrom and coupled to end bracket 514 of the carriage for moving the carriage in a stepwise fashion between various welding positions as described below. As seen in FIGS. 2B and 17, the carriage 500 includes a plurality of welding heads 525 such that a plurality of circumferential wire ends can be welded simultaneously. Each welding head 525 includes a pair of electrode jaws 530 which are pivotally mounted between the ends of a pair of downwardly depending arms 540 by means of insulating pivot connections 532. A jaw cylinder 545 is pivotally coupled between the electrode jaws at an end remote from their pivot connection and actuatable for moving the jaws between an open position as seen in FIG. 17 and a closed position under constant pressure as shown in FIGS. 18 and 19. The cylinder is insulatively mounted to at least one of the jaws so as not to short out the electrodes.

Each of the electrode jaws 530 includes a cylindrical recess 532 for partially circumscribing a circumferential wire.

Arms 540 are mounted to a slide 550 slidably captured by guide rail 560 for vertical motion therealong in the direction indicated by arrow G in FIG. 17. A cylinder 555 supported between arms 508 and 510 by means of a plate 556 includes a shaft (not shown) coupled to slide 550 for raising the slide and, therefore, electrode jaws 530 between an inoperative position and lowering the jaws to an operative position. Mounted to each of the slides 550 are power supplying transformers 554 for supplying operating power to the electrode jaws.

To provide a line upset weld, the jaws initially are clamped against the edges of a pair of aligned, overlapped circumferential wires 12 as seen in FIG. 18B. By virtue of the comb assembly stop discussed above, the overlap can be selected to fall within the desired range of 0.25–0.75 inches to provide the upset weld desired. With the jaws clamped with a predetermined pressure, the power supplies are actuated for heating the wires and fusing them as shown in FIG. 19. Closely controlled values of clamping pressure, current, current duration and holding time enable a 100% line upset weld to be made. The resultant structure is shown in FIG. 19A and comprises a 100% line upset weld with greater strength than available with typical offset welds previously provided with wire cage formation. Also, with the circumferential wires coaxially welded, skewing of the reinforcing cage is avoided. Additionally, the flash wings 13 extending from opposite sides of the welded junction of the circumfer-ential wires serve as an anchor when the concrete is molded around the cage so formed.

Once one of the welding steps has been completed, the cylinder 545 is actuated to open the jaws while the jaw assemblies are raised by cylinders 555 and the welding heads are moved an incremental distance corresponding to the spacing between adjacent circumferential wires and the welding cycle is repeated. With this construction, several welds are made simultaneously and the cycle is repeated as required to weld each of the circumferential wire junctions. The following parameter values have been found effective in providing 100% upset weld using the welding unit construction disclosed herein.

| Wire Diameter | Wire Overlap | Welding Current | Jaw Force | Time of Weld |
|---|---|---|---|---|
| .175 in. | .25 in. | 7900 Amp | 500 lbs. | .3 sec. |
| .226 in. | .25 in. | 8000 Amp | 650 lbs. | .5 sec. |
| .292 in. | .4 in. | 8800 Amp | 900 lbs. | .5 sec. |
| .306 in. | .25 in. | 8800 Amp | 900 lbs. | .5 sec. |

Since the bell end circumferential wires of the fabric are frequently spaced a greater distance apart than the remaining wires, in the preferred embodiment a second welding carriage assembly 500' (FIG. 2B) is provided with a single welding head 525'. The construction and control of this unit is the same as that of units 500 and 525 and is not repeated herein.

Once the welding step has been completed, the upper gripping jaws (now rotated to be in the lower position) are opened by actuating the jaw latch cylinder 260 and jaw actuating cylinder 270 permitting the completed cylindrical cage to be removed from the jaw assembly in a direction indicated by arrow H in FIG. 20 which is at right angles to the motion of the fabric into the machine and transported by means of the outfeed conveyors 60. Conveyor 60 is a powered conveyor bed mounted on scissor jacks 580 and tilted to provide transportation of the completed cylindrical cage from the forming machine to the successive bell end forming machine disclosed in detail in concurrently filed U.S. Pat. application entitled PIPE CAGE END FORMING MACHINE Ser. No. 542,342 filed Jan. 20, 1975. The outfeed conveyor 60 includes a pair of spring adjustable arms 582 on either side of the cage to provide stability to the cage as it is transported from the forming machine into the bell end forming machine. Having described the construction of the machine, a description of a cycle of operation is now presented together with the control elements for actuating the various cylinders and motors disclosed herein.

OPERATION

Figure 21:
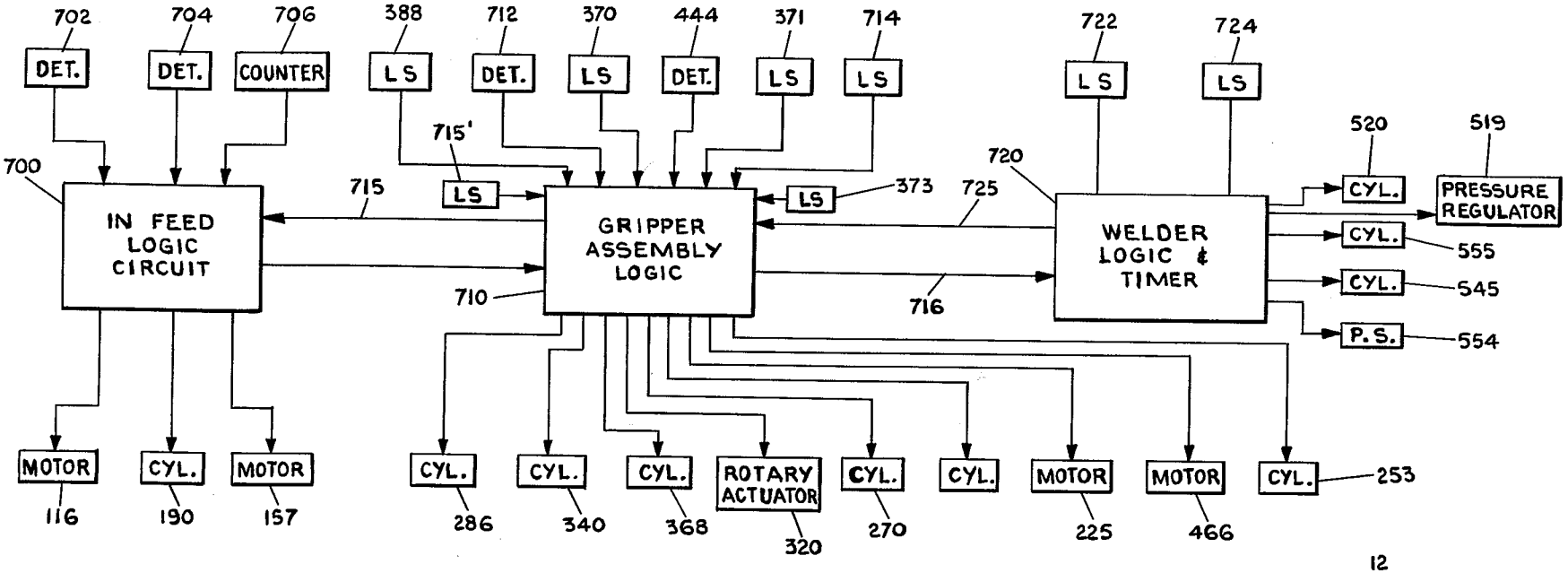
FIG. 21 is a block diagram of the control system of the present invention.

At the beginning of a cycle of operation, the infeed carriage and gripper assemblies are positioned as basically seen in FIG. 12. The movable clamping means of the carriage assembly is, however, in an open position ready to receive a section of wire fabric from the preceding fabric shearing stage. As the gripper assemblies complete the forming operation on an existing piece of fabric and the welding is completed, the infeed carriage assembly is receiving the next successive section of wire fabric which can be the same length as the preceding section or can be any number of different lengths for forming a different diameter cage. A detector 702 (FIG. 21) is positioned slightly upstream of the infeed clamping means to detect the incoming wire fabric and is coupled to the infeed logic circuit 700 for supplying a signal to the logic circuit indicating that a section of wire is present. The infeed logic circuit generates a signal to actuate cylinder 190 for closing the clamping means and also actuating motor 157 for advancing the wire fabric by the movable belts of the clamping means until the leading transverse wire of the fabric is detected by a second transverse wire detector 704 (FIG. 21) positioned on the clamping assembly 160 at the leading edge and coupled to circuit 700. Circuit 700 responds to a signal from detector 704 to deactuate motor 157 with the leading transverse wire of the fabric section protruding slightly forwardly of the clamping means associated with the infeed system.

At this time, the welding step is being completed and subsequently, the gripping jaws are in an open position to receive the subsequent section of fabric. Upon deactuation of motor 157, the logic circuit provides a control signal to motor 116 to actuate infeed carriage 100 advancing the wire section to a position slightly downstream of gripping assembly 30. A counter 706 coupled to the infeed carriage provides a plurality of pulses to circuit 700 corresponding to the length of travel of the infeed carriage and, therefore, the position of the wire fabric. Circuit 700 includes a digital memory and comparator for comparing the incoming pulses from counter 706 with the number of stored counts corresponding to the desired end position of the infeed carriage. As the stored count is reached, circuit 700 generates a decelerating signal applied to initially slow down and then stop motor 116 to stop the infeed carriage. As this occurs, a signal from circuit 700 actuates motor 157 to expel the fabric section from the infeed means into the awaiting gripping assemblies.

At the same time motor 157 is actuated, the infeed logic circuit 700 applies a signal to the gripper assembly logic circuit 710 which actuates cylinder 286 of the gripping assembly 30 for raising guide ramp 282 to guide the leading edge of the fabric between the open jaws of this gripping assembly. It is noted here that the combing mechanism 300 of assembly 30 is in its raised position as seen in FIG. 13.

The wire fabric enters gripping assembly 40 and contacts the lowered comb and detection unit 300, contacting shoe 380 which actuates limit switch 388 (identical to the structure shown in FIG. 7) which applies signals to circuit 710 which responds to apply a control signal to motor 157 via the feedback coupling 715 between circuits 710 and 700 which causes the successive deceleration and stopping of the drive motor 157.

Upon actuation of limit switch 388 by fabric section 10 indicating the leading edge of the fabric is extended through the jaws of gripping assembly 40 such that the leading transverse wire is immediately adjacent the upstream side of the comb, circuit 710 generates a signal applied to actuate comb cylinder 340 to lower the comb into position. A limit switch 373 (FIG. 21) is positioned on the comb assembly to be actuated when the comb is fully lowered. Switch 373 is coupled to circuit 710 to actuate motor 320 of the comb assembly for forcing the free ends of the circumferential wires through the comb straightening them. During this step, the fabric section is supported by the open infeed means. Limit switch 370 is actuated indicating when the combing step is completed. Switch 370 is a multiple-position switch which is coupled to circuit 710 for applying a control signal to rotary actuator 320 for successively decelerating and stopping rotary actuator 320 for smooth operation.

Upon actuation of limit switch 371 coupled to circuit 710 and indicating that the leading edge of the fabric is in its predetermined reference position, jaw cylinder 270 of assembly 40 is actuated closing the pivoted upper jaw which when closed, actuates a limit switch 715' coupled to the gripper assembly logic circuit for subsequently actuating the latch cylinder 260 for locking the gripping jaws of gripping assembly 40 in position.

Upon completing the combing of the leading edge of the infed fabric, the signal from jaw closed limit switch 715' circuit 710 responds to actuate carriage motor 466 of gripper assembly 40 and the equivalent motor 466 of gripper assembly 30 causing the gripper assemblies to spread apart moving in opposite directions. A signal is also applied to circuit 700 via conductor 715 to move the infeed means to the left end as seen in FIG. 12. At this time, the gripper jaws of assembly 30 are still in an open position. A detector 712 positioned on gripper assembly 30 to detect the fabric passing therethrough as the gripper assemblies move outwardly from the center position and provides a signal when the trailing edge of the fabric section has approached a position such that the trailing transverse wire is slightly downstream of the comb associated with assembly 30. The signal from detector 712 effects the generation of a signal by circuit 710 to decelerate the gripper carriage motors 466 and simultaneously actuate rotary actuator 320 of the left gripper assembly to lower the comb and detecting assembly 300 to its reference position and lower the comb into its operative position.

As the drive arm 306 of assembly 30 continues swinging down to the right in the figures forcing the comb through the ends of the trailing circumferential wires until the detection shoe 380 engages the free trailing edge of the fabric and actuates limit switch 388. Switch 388 is coupled to circuit 710 for developing a signal applied to decelerate and stop comb rotary actuator 320 and also activate the jaw locking and latch cylinders associated with gripper assembly 30 after combing has been accomplished.

With the free ends of the leading and trailing edges of the fabric combed and, therefore, straightened, and the fabric clamped at a position spaced inwardly slightly from the free ends, the forming operation is commenced, initiated by the jaw closed limit switch associated with the jaws of assembly 30. Circuit 710 applies a signal to the carriage motors 466 of both gripping assemblies to drive the gripper assembly carriages toward each other to a center position (FIG. 15) while simultaneously actuating motor 225 of each of the gripper assemblies to provide rotation of the gripping jaws of each assembly.

Detectors 444 of each assembly detect any motion caused by deviation of the synchronous motion between the rotation of the gripping jaws and the lineal advancement of the gripping assemblies to correct the drive speed for motors 466. Circuit 710 includes conventional dual closed loop servoamplifier systems coupled to detectors 444 and motors 466 for providing this control function for each of the gripper assemblies. The gripper assemblies advance to the center position as shown in FIG. 15 whereupon they engage a limit switch 714 detecting the completion of their travel and which initiates actuation of cylinder 253 for abutting the free ends of the circumferential wires. After a predetermined delay sufficient to achieve this abutting operation, circuit 710 generates a pulse applied to the welding logic and timer circuit 720 via conductor 716 to initiate the welding sequence.

Upon receipt of a control signal from circuit 710, the welding control circuit 720 actuates cylinder 520 to horizontally position the welding heads at a predetermined position aligned with overlapped wire ends. The motion of slide 500 is detected by a multiposition limit switch 722 and cam means positioned between the slide and the guide support rails 502 and 504 such that the position of the slide along the support members is always known. Once the initial position has been reached, limit switch 722 actuates circuit 720 to in turn actuate cylinders 555 to lower the welding jaw electrodes. Once the electrodes are in a lowered position, a limit switch 724 is actuated indicating this positioning of the welding heads whereupon cylinders 545 are actuated to clamp the welding jaws around the abutted ends of the circumferential wires as seen in FIG. 18B. Simultaneously, the welder power supply including transformers 554 associated with each welding jaw are actuated for a predetermined time depending upon the diameter of the wire for providing a 100% upset weld. To provide adjustable clamping pressure by the welding jaws, the cylinders 520 are commonly coupled to a pressurized source of hydraulic fluid including an adjustable pressure regulator 519.

After a conventional timer circuit included in welding control circuit 720 has run out indicating the welding operation has been completed, the jaw cylinders 545 are actuated to open the jaws. Cylinders 555 are then actuated to raise the welding heads and cylinder 520 is moved incrementally to the next welding position whereupon limit switch 722 generates a second welding sequence initiation signal.

Thus, each welding step is repeated until all of the circumferential wires have been welded in 100% upset fashion as seen in FIG. 19A. Upon completion of the last welding sequence, circuit 720 provides a control signal to the gripper assembly logic circuit 710 via interconnecting conductor 725 to actuate the jaw and latch cylinders 270 and 260, respectively, of each gripping assembly permitting the release of the completed cylindrical cage as seen in FIG. 20. This signal likewise can be employed to actuate the powered outfeed conveyor 60. A cage detector can bee employed to detect when the completed cage has cleared the gripping assembly area whereupon a new cycle of operation can be commenced.

It will be appreciated that with the unique gripping assemblies of the present invention, including the rotatable and lineally movable gripping jaws which include detecting means for assuring that any length of wire fabric will be gripped in a predetermined reference by the pair of gripping jaws, the forming machine of the present invention can successively manufacture different sized cages from different lengths of fabric without readjustment of the machine. This is particularly useful when successively manufacturing inner and outer reinforced cages for relatively large concrete pipes.

It will be understood by those skilled in the art that various modifications to the preferred embodiment disclosed herein can be made. Further, it will be understood that the system is not limited to the manufacture of cylindrical pipe reinforcing cages from wire fabric. It has equal application for manufacturing closed loop objects from any type of material including sheet metal and plastic. Further, the inertial detection and speed control utilized in conjunction with the gripper assembly will have application to other types of machinery. In addition, the infeed carriage likewise can be employed with a variety of equipment requiring positive advancement of materials with continuous support along the length of travel of the material being transported. In some embodiments, the carriages for the gripper means can be mounted in a virtually frictionless fashion and only the gripping means rotated to advance the ends of the work piece together. These and other modifications and uses of the present invention will, however, fall within the various aspects of the invention as defined by the appended claims.

The embodiments of the invention in which an exclusive property or privilege is claimed are defined as follows.

1. Apparatus for forming a formable work piece into a closed loop structure comprising:

spaced rotatably and movably mounted gripping means for gripping opposite ends of the work piece; and means for rotating said gripping means and simultaneously advancing said gripping means toward one another such that the ends of the work piece are brought together and the work piece is formed to define a closed loop as said gripping means approach one another.

2. The apparatus as defined in claim 1 wherein each said gripping means comprises a pair of gripping jaws.

3. The apparatus as defined in claim 2 wherein each of said gripping jaws comprises a pair of elongated jaw members and means for opening and closing said jaw member and wherein one of said jaw members includes an elongated recess formed therein and a movable blade extending along said gripping jaw captively held within said recess; and means between said blade and the floor of said recess for urging said blade outwardly from said one jaw member toward the remaining jaw member such that said gripping jaws can accommodate an uneven surface being held by said gripping jaws.

4. The apparatus as defined in claim 3 wherein said means for opening and closing said jaw members comprises a pivotal coupling means for pivotally coupling one end of at least one of said jaw members to the other.

5. The apparatus as defined in claim 4 and further including latch means for locking said jaws in a closed position and actuating means for opening and closing said jaws and said latch means when said jaws are closed.

6. The apparatus as defined in claim 1 wherein said means for rotating and advancing said spaced gripping means comprises:

a carriage for each said gripping means;

means for rotatably coupling each said gripping means to one of said carriages;

carriage drive means coupled to each said carriage for advancing said carriage; and a separate rotating drive means coupled to said gripping means for rotating said gripping means.

7. The apparatus as defined in claim 6 comprising: synchronization means for synchronizing said carriage drive means and said rotating drive means whereby said carriages are brought toward one another in accordance with the rate at which the ends of the work piece are rotated toward one another.

8. The apparatus of claim 7 wherein said synchronization means includes:

a slide member slidably coupling each gripping means to an associated carriage and bias means extending between each slide and its associated carriage;

detection means for detecting relative movement between said carriage and its associated slide means for providing a control signal representative thereof; and control means coupled to said detection means and to said carriage drive means for controlling said carriage speed to insure that the ends of the work piece come together at a rate synchronized with the rate at which they are rolled over inwardly towards one another.

9. The apparatus as defined in claim 8 wherein said detection means includes a guide means coupled to said carriage and including a seismic mass mounted thereto and bias means anchored at one end of said guide means and engaging said seismic mass, and a motion detector positioned on said slide and including a detecting element engaging said seismic mass to provide a varying signal when said mass moves relative to said detector.

10. The apparatus as defined in claim 8 wherein the ratio of the mass of said seismic mass and said slide is directly proportional to the ratio of the elastic constant of said bias means associated with said mass and the bias means coupling said slide and said carriage.

11. The apparatus as defined in claim 8 wherein said means rotatably coupling said gripping means to said carriage comprises each said gripping means being rotatably coupled to its said associated slide; said slide including said rotating drive means, said drive means rotating said gripping jaws approximately 180° as said carriages travel from a maximum spaced apart position to come together.

12. The apparatus as defined in claim 11 wherein each of said gripping jaws comprises a pair of elongated jaw members for gripping generally planar stock, pivotal coupling means for pivotally coupling one end of at least one of said jaw members to the other, latch means for locking said jaws in a closed position, and actuating means for opening and closing said jaws and actuating said latch means when said jaws are closed whereby said object can be removed from said apparatus when said jaws are open.

13. The apparatus as defined in claim 1 and further including infeed means for advancing a work piece to said gripping means.

14. The apparatus as defined in claim 13 wherein said infeed means comprises a carriage guidably supported by guide means and including drive means for moving said carriage along said guide means, and article support means coupled to said carriage and extensible and retractable as said carriage moves for providing continuous support for an elongated work piece transported by said apparatus.

15. The apparatus as defined in claim 14 wherein said article support means comprises a plurality of rollers each mounted to a roller support movable along the path of travel of said carriage and positioned with respect to said carriage such that said rollers support articles transported by said carriage, and a plurality of intercoupled drive means for providing progressively greater lineal motions when one of said drive means is coupled to said carriage and wherein each of said roller supports is coupled to one of said drive means such that as said carriage is advanced from an end position, successive support rollers are advanced to extend in spaced supporting relationship behind said carriage, and as said carriage is returned to said end, said support rollers are collapsed together.

16. The apparatus as defined in claim 15 wherein said drive means associated with said support rollers includes first and second spaced rotatable axles each including a plurality of sprockets fixedly mounted thereto wherein each sprocket has a progressively different diameter than the remaining sprockets and a plurality of chains coupling sprockets of the same diameter mounted on each of the spaced axles and means coupling one of said chains to said carriage and each of the remaining chains to one of said roller supports in a predetermined relationship.

17. A machine for forming reinforcing cages for concrete pipe from lengths of wire fabric comprising:

support means including elongated guide means extending therealong;

a pair of carriage means movably mounted on said support means for movement along said guide mean;

a pair of gripping assemblies, each including gripping jaws rotatably mounted therein;

means for coupling each one of said gripping assemblies to one of said carriage means;

means for rotating said gripping jaws within said gripping assemblies;

infeed means for advancing a section of wire fabric to said gripping assemblies;

means for actuating said gripping jaws to grip opposite ends of said fabric section; and carriage drive means coupled to said carriages for advancing said carriages towards one another while said gripping jaws are rotated by said rotating means for forming a cylindrical cage as said gripping assemblies meet one another.

18. The apparatus as defined in claim 17 wherein each of said gripping assemblies includes slide means slidably mounted to said carriage and coupled thereto by biasing means.

19. The apparatus as defined in claim 18 and further including detector means for detecting relative movement between each of said slides and said carriages, which relative movement is related to resistive forces generated by said fabric section during formation of a cylinder; and control means coupled to said detector means and to said carriage drive for varying the carriage speed to control movement of said carriages in accordance with the rate of rotation of said gripping jaws.

20. The apparatus as defined in claim 17 wherein said gripping assemblies further include means for combing wire ends of said fabric section for generally straightening said wires before the cylindrical cage is formed, whereby said wire ends will be predictably located when the ends of said fabric section are brought together.

21. The apparatus as defined in claim 20 wherein each of said combing means includes means for positioning an end of said fabric in predetermined relationship to said gripping jaws such that as said cylinder is formed, said wire ends overlap slightly and are spaced slightly from one another such that tangling of said wire ends is avoided as the ends of said fabric are brought together.

22. The apparatus as defined in claim 21 wherein one of said gripping jaws is movable transversely with respect to the motion of said gripping assembly in which it is positioned whereby after said fabric ends have been brought together, said gripping jaw can be moved transversely to bring said slightly spaced wire ends into abutment.

23. The apparatus as defined in claim 17 and further including a welding unit positioned on said support means to align with the junction of said ends of said circumferentially extending wires and including clamping electrodes for clamping abutting wires with a predetermined pressure and for applying a predetermined welding energy to said abutting wires for providing an upset weld to each junction of said ends of said circumferentially extending wires.

24. The apparatus as defined in claim 17 wherein said infeed means comprises a carriage guidably supported by guide means and including drive means for moving said carriage along said guide means, and article support means coupled to said carriage and extensible and retractable as said carriage moves for providing continuous support for an elongated work piece transported by said apparatus.

25. The apparatus as defined in claim 24 wherein said article support means comprises a plurality of rollers each mounted to a roller support movable along the path of travel of said carriage and positioned with respect to said carriage such that said rollers support articles transported by said carriage, and a plurality of intercoupled drive means for providing progressively greater lineal motions when one of said drive means is coupled to said carriage and wherein each of said roller supports is coupled to one of said drive means such that as said carriage is advanced from an end position, successive support rollers are advanced to extend in spaced supporting relationship behind said carriage, and as said carriage is returned to said end, said support rollers are collapsed together.

26. The apparatus as defined in claim 25 wherein said drive means associated with said support rollers includes first and second spaced rotatable axles each including a plurality of sprockets fixedly mounted thereto wherein each sprocket has a progressively different diameter than the remaining sprockets and a plurality of chains coupling sprockets of the same diameter mounted on each of the spaced axles and means coupling one of said chains to said carriage and each of the remaining chains to one of said roller supports in a predetermined relationship.

27. The apparatus as defined in claim 17 wherein said infeed means comprises:

infeed carriage means guidably supported by said guide means and including drive means for moving said carriage along said guide means; and clamping means including first and second elements for selectively clamping said fabric section therebetween, said clamping means being coupled to said carriage assembly for movement therewith; said first and second elements including movable means engaging said fabric section held therebetween for moving said work piece with respect to said clamping means whereby said fabric section can be fed from said clamping means to said gripping means by said movable means.

28. Apparatus for advancing a work piece comprising:

a support structure including guide means extending therealong;

carriage means guidably supported by said guide means and including drive means for moving said carriage along said guide means; and clamping means including first and second elements for selectively clamping a work piece therebetween, said clamping means coupled to said carriage assembly for movement therewith and wherein said first and second elements include movable means engaging a work piece held therebetween for moving said work piece with respect to said clamping means.

29. The apparatus as defined in claim 28 and further including article support means coupled to one of said carriage and clamping means and extensible and retractable as said carriage moves for providing continuous support for an elongated work piece transported by said apparatus as said clamping means and carriage travel along said guide means.

30. The apparatus as defined in claim 29 wherein said article support means comprises a plurality of rollers each mounted to a roller support movable along the path of travel of said carriage and positioned with respect to said carriage such that said rollers support articles transported by said carriage, and a plurality of intercoupled drive means for providing progressively greater lineal motions when one of said drive means is coupled to said carriage and wherein each of said roller supports is coupled to one of said drive means such that as said carriage is advanced from an end position, successive support rollers are advanced to extend in spaced supporting relationship behind said carriage, and as said carriage is returned to said end, said support rollers are collapsed together.

31. The apparatus as defined in claim 30 wherein said drive means associated with said support rollers includes first and second spaced rotatable axles each including a plurality of sprockets fixedly mounnted thereto wherein each sprocket has a progressively different diameter than the remaining sprockets and a plurality of chains coupling sprockets of the same diameter mounted on each of the spaced axles and means coupling one of said chains to said carriage and each of the remaining chains to one of said roller supports in a predetermined relationship.

32. The apparatus as defined in claim 31 wherein at least one of said movable means of said first or second elements comprises an endless loop belt supported between rollers and including drive means for moving said belt.

33. The apparatus as defined in claim 32 wherein said first and second elements each include a frame and wherein means are provided for coupling said frames for moving said frames between an open position spaced from one another for receiving a work piece and a closed position toward one another for clamping a work piece between said frames to be engaged by said belt.

34. The apparatus as defined in claim 33 and further including control means for selectively actuating said carriage and said drive means for said endless loop belt such that a work piece can be sequentially gripped by said clamping means transported by said carriage along said guide means and ejected from said clamping means by the actuation of said drive means for said movable belt.

35. Welding apparatus for welding free ends of circumferential wires defining a cylindrical wire cage to provide a line upset welded junction between said wires comprising:

means for holding opposite ends of a section of wire fabric with circumferentially extending wires having free ends positioned in overlapping abutment with each other;

a carriage assembly movable along the length of said cylinder and means coupling at least one welding head to said carriage for movement toward and away from said cylinder, said welding head including at least one pair of gripping electrodes movably and insulatively mounted with respect to each other, said head including means coupled to said electrodes for opening and closing said electrodes;

power suppply means coupled to said electrodes; and positioning means for sequentially positioning said welding head in aligned relationship to a circumferential wire, lowering said gripping electrodes into proximity with said free ends of said circumferential wire, closing means for closing said electrodes to grip said free ends and means for applying welding energy to said electrodes for providing a line upset weld between the ends of said circumferential wire.

36. The apparatus as defined in claim 35 wherein said carriage includes a plurality of spaced welding heads each including at least one pair of gripping electrodes movably and insulatively mounted with respect to each other, each head including means coupled to said electrodes for opening and closing said electrodes; and power supply means coupled to said electrodes such that a plurality of welds can be made simultaneously.

37. The apparatus as defined in claim 35 wherein each gripping electrode includes a recess formed therein for circumscribing a portion of a circumferential wire to be welded such that said gripping electrodes surround a significant portion of said circumferential wires during welding.

38. The apparatus as defined in claim 37 wherein said gripping electrodes are spaced from one another during the welding so that resultant flash can escape from the welded wire between the spaced opposed surfaces of the gripping electrodes during welding.

39. For use in manufacturing pipe reinforcing cages of cylindrical construction whereby free ends of circumferentially extending wires are welded to provide a cylindrical cage, apparatus for straightening the free ends prior to welding comprising:

combing means having a plurality of teeth defining circumferential wire receiving notches therebetween;

support means for the wire fabric for positioning said fabric with said free ends engaged within said notches of said combing means; and means for providing relative motion between said combing means and said wire fabric such that said combing means straightens said circumferential wire ends.

40. Apparatus for advancing an article such as an elongated work piece comprising:

a base including guide means extending therealong;

carriage means for holding an article, said carriage means guidably supported by said guide means and including drive means for moving said carriage along said guide means; and article support means coupled to said carriage and extensible and retractable as said carriage moves for providing continuous support for an elongated work piece transported by said apparatus as said carriage travels along said guide means.

41. The apparatus as defined in claim 40 wherein said article support means comprises a plurality of rollers each mounted to a roller support movable along the path of travel of said carriage and positioned with respect to said carriage such that said rollers support articles transported by said carriage, and a plurality of intercoupled drive means for providing progressively greater lineal motions when one of said drive means is coupled to said carriage and wherein each of said roller supports is coupled to one of said drive means such that as said carriage is advanced from an end position, successive support rollers are advanced to extend in spaced supporting relationship behind said carriage, and as said carriage is returned to said end, said support rollers are collapsed together.

42. The apparatus as defined in claim 41 wherein said drive means associated with said support rollers includes first and second spaced rotatable axles each including a plurality of sprockets fixedly mounted thereto wherein each sprocket has a progressively different diameter than the remaining sprockets and a plurality of chains coupling sprockets of the same diameter mounted on each of the spaced axles and means coupling one of said chains to said carriage and each of the remaining chains to one of said roller supports in a predetermined relationship.

43. A method for forming pipe reinforcing cages, pipe or like closed loop member from a formable work piece comprising:

gripping opposite ends of the work piece and advancing the ends toward one another while simultaneously rotating said ends towards one another such that the work piece is formed to define a closed loop as the ends thereof are brought together.

44. The method as defined in claim 43 and including the additional step of synchronizing said advancing step with said rotating step to define a predetermined shaped loop as the ends are brought together.

45. The method as defined in claim 44 for use in forming a cylindrical wire reinforcing cage from a sheet of wire fabric and comprising the additional step of straightening the wire ends extending from said opposite ends of a wire fabric section before said advancing step is completed whereby said wire ends will be predictably positioned relative to one another when said fabric ends are brought together.

46. The method as defined in claim 45 and further including the steps of holding the closed loop in position after said advancing step and welding the wire ends during said holding step.

47. A method of welding wire reinforcing cages for joining free ends of circumferential wires of the cage comprising the steps of:

holding the cylindrical cage with the free circumferential wire ends abutting and overlapping;

line upset welding the overlapped circumferential wire free ends.

48. The method as defined in claim 47 wherein said line upset welding step is carried out to produce a 100% line upset weld.

49. The method as defined in claim 48 wherein said line upset welding step includes the steps of clamping a pair of electrode jaws around abutted overlapped circumferential wire ends and applying electrical energy and a clamping force to the electrode jaws in relationship to the welding time as generally set forth in the following table to provide a 100% line upset weld:

| Wire Diameter | Wire Overlap | Welding Current | Jaw Force | Time of Weld |
|---|---|---|---|---|
| .175 in. | .25 in. | 7900 Amp | 500 lbs. | .3 sec. |
| .226 in. | .25 in. | 8000 Amp | 650 lbs. | .5 sec. |
| .292 in. | .4 in. | 8800 Amp | 900 lbs. | .5 sec. |
| .306 in. | .25 in. | 8800 Amp | 900 lbs. | .5 sec. |

50. The method as defined in claim 49 and further including the steps of providing a plurality of welding heads, each of which is operable to clamp abutting wire free ends together and to apply sufficient current to effect said line upset welding sequentially positioning said welding heads with respect to said wire ends and repeating said clamping and applying steps until each circumferential wire defining a cylindrical wire reinforcing cage is welded.

* * * * *

UNITED STATES PATENT AND TRADEMARK OFFICE

CERTIFICATE OF CORRECTION

PATENT NO. : 3,939,879

DATED : February 24, 1976

INVENTOR(S) : Wilbur E. Tolliver and Daniel J. Borodin

It is certified that error appears in the above-identified patent and that said Letters Patent are hereby corrected as shown below:

Column 4, line 47;
"betweenn" should be --between--;
Column 7, line 68;
"annd" should be --and--;
Column 11, line 9;
After "may" insert --be--;
Column 12, line 5;
After "plate" insert --stop--;
Column 12, line 11;
"cimcumferential" should be --circumferential--;
Column 12, line 21;
"380'" should be --280'--;
Column 15, line 46;
"circiles" should be --circles--;
Column 20, line 41;
"bee" should be --be--;
Column 24, line 64;
"support" should be --supporting--;
Column 25, line 34;
"mounnted" should be --mounted--;
Column 26, line 11;
"suppply" should be --supply--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*